US012352268B2

(12) United States Patent
Montie et al.

(10) Patent No.: US 12,352,268 B2
(45) Date of Patent: Jul. 8, 2025

(54) PUMPS, COMPRESSORS, AND EXPANDERS WITH A TEARDROP-SHAPED ROTOR

(71) Applicant: Rotoliptic Technologies Incorporated, Squamish (CA)

(72) Inventors: Greg John Montie, Squamish (CA); Peter Thomas Christopher Suke, Squamish (CA); Rogan David Milatz, Squamish (CA); Robert John Charles Pearson, Squamish (CA); Braden Adam Murphy, Calgary (CA)

(73) Assignee: Rotoliptic Technologies Incorporated, Squamish (CA)

( * ) Notice: Subject to any disclaimer, the term of this patent is extended or adjusted under 35 U.S.C. 154(b) by 0 days.

(21) Appl. No.: 18/346,234

(22) Filed: Jul. 2, 2023

(65) Prior Publication Data

US 2023/0417242 A1 Dec. 28, 2023

Related U.S. Application Data

(63) Continuation of application No. PCT/CA2022/050021, filed on Jan. 7, 2022.

(60) Provisional application No. 63/144,200, filed on Feb. 1, 2021, provisional application No. 63/135,069, filed on Jan. 8, 2021.

(51) Int. Cl.
*F04C 2/107* (2006.01)

(52) U.S. Cl.
CPC ..... *F04C 2/1076* (2013.01); *F04C 2250/20* (2013.01); *F04C 2250/30* (2013.01)

(58) Field of Classification Search
CPC ..... F04C 2/1076; F04C 2250/20; F04C 2250/30
See application file for complete search history.

(56) References Cited

U.S. PATENT DOCUMENTS

| | | | |
|---|---|---|---|
| 724,994 | A | 4/1903 | Cooley |
| 1,340,625 | A | 5/1920 | Planche |
| 1,575,987 | A | 3/1926 | Gilman |
| 1,636,486 | A | 7/1927 | Planche |
| 1,686,569 | A | 10/1928 | McMillan |
| 1,738,645 | A | 12/1929 | Gilman |

(Continued)

FOREIGN PATENT DOCUMENTS

| | | | |
|---|---|---|---|
| CA | 2701474 | A1 | 4/2009 |
| DE | 2014499 | A1 | 10/1971 |

(Continued)

OTHER PUBLICATIONS

Ansdale, R., The Wankel RC Engine, (1968), p. 20.

(Continued)

*Primary Examiner* — Mary A Davis
(74) *Attorney, Agent, or Firm* — Cook Alex Ltd.

(57) ABSTRACT

Rotary positive displacement machines can include a rotor having a teardrop-shaped profile that undergoes planetary motion relative to a stator having an elliptical or near-elliptical profile. In some embodiments, these rotary positive displacement machines can be used for a variety of applications including as positive displacement pumps. In some embodiments the rotor and stator are helical. In some embodiments the rotor comprises a dynamic seal. Aspects of the machine geometry can be selected to provide operational and/or durability benefits.

20 Claims, 19 Drawing Sheets

(56) References Cited

U.S. PATENT DOCUMENTS

| | | | |
|---|---|---|---|
| 1,892,217 | A | 12/1932 | Moineau |
| 2,612,022 | A | 9/1952 | Keys |
| 2,919,062 | A | 12/1959 | Tryhorn |
| 2,988,008 | A | 6/1961 | Wankel |
| 3,208,391 | A | 9/1965 | Lindberg |
| 3,259,113 | A | 7/1966 | Hamada |
| 3,279,388 | A | 10/1966 | Roudaut |
| 3,296,874 | A | 1/1967 | Wyczalek |
| 3,299,822 | A | 1/1967 | Payne |
| 3,302,870 | A | 2/1967 | Schell |
| 3,387,772 | A | 6/1968 | Wutz |
| 3,398,643 | A | 8/1968 | Schudt |
| 3,458,120 | A | 7/1969 | Pfaff et al. |
| 3,465,729 | A | 9/1969 | Jones |
| 3,512,904 | A | 5/1970 | Allen |
| 3,533,716 | A | 10/1970 | Grun |
| 3,728,049 | A | 4/1973 | Miller |
| 3,764,239 | A | 10/1973 | Huf |
| 3,822,972 | A | 7/1974 | Ogly et al. |
| 3,917,437 | A | 11/1975 | Link |
| 3,918,137 | A | 11/1975 | Telang et al. |
| 3,958,906 | A | 5/1976 | Catterson et al. |
| 3,990,817 | A | 11/1976 | Ruf et al. |
| 4,012,180 | A | 3/1977 | Berkowitz et al. |
| 4,018,548 | A | 4/1977 | Berkowitz |
| 4,028,021 | A | 6/1977 | Berkowitz |
| 4,061,445 | A | 12/1977 | Doshi |
| 4,118,157 | A | 10/1978 | Mayer |
| 4,144,001 | A | 3/1979 | Streicher |
| 4,182,499 | A | 1/1980 | Kemper |
| 4,218,199 | A | 8/1980 | Eiermann |
| 4,296,500 | A | 10/1981 | Monties et al. |
| 4,299,097 | A | 11/1981 | Shank et al. |
| 4,330,240 | A | 5/1982 | Eslinger |
| 4,382,755 | A | 5/1983 | Hoffmann |
| 4,395,206 | A | 7/1983 | Hoffmann |
| 4,397,619 | A | 8/1983 | Aliquander et al. |
| 4,407,639 | A | 10/1983 | Maruyama |
| 4,410,305 | A | 10/1983 | Shank et al. |
| 4,487,561 | A | 12/1984 | Eiermann |
| 4,504,202 | A | 3/1985 | Saegusa |
| 4,507,067 | A | 3/1985 | Hansen |
| 4,519,206 | A | 5/1985 | Van Michaels |
| 4,551,073 | A | 11/1985 | Schwab |
| 4,594,060 | A | 6/1986 | Schwab |
| 4,728,270 | A | 3/1988 | Hoffmann |
| 4,802,830 | A | 2/1989 | Nakajima |
| 4,934,325 | A | 6/1990 | Snyder |
| 5,027,653 | A | 7/1991 | Foran |
| 5,069,606 | A | 12/1991 | Bachellerie |
| 5,096,004 | A | 3/1992 | Ide |
| 5,127,377 | A | 7/1992 | Yang |
| 5,169,298 | A | 12/1992 | Hekman et al. |
| 5,171,138 | A | 12/1992 | Forrest |
| 5,295,814 | A | 3/1994 | Uebel |
| 5,302,096 | A | 4/1994 | Cavalleri |
| 5,318,415 | A | 6/1994 | Verhoeven |
| 5,372,107 | A | 12/1994 | Smythe |
| 5,379,736 | A | 1/1995 | Anderson |
| 5,439,359 | A | 8/1995 | Leroy et al. |
| 5,609,475 | A | 3/1997 | Eiermann |
| 5,941,305 | A | 8/1999 | Thrasher et al. |
| 6,074,184 | A | 6/2000 | Imai |
| 6,093,004 | A | 7/2000 | Varadan et al. |
| 6,120,267 | A | 9/2000 | Cunningham |
| 6,213,744 | B1 | 4/2001 | Choroszylow et al. |
| 6,236,897 | B1 | 5/2001 | Lee et al. |
| 6,530,357 | B1 | 3/2003 | Yaroshenko |
| 6,718,938 | B2 | 4/2004 | Szorenyi |
| 6,776,136 | B1 | 8/2004 | Kazempour |
| 6,923,628 | B1 | 8/2005 | Otto |
| 6,926,505 | B2 | 8/2005 | Sbarounis |
| 6,974,313 | B2 | 12/2005 | Beaudoin |
| 7,101,160 | B2 | 9/2006 | Gennami et al. |
| 7,117,839 | B2 | 10/2006 | Horstin |
| 7,395,805 | B1 | 7/2008 | MacMurray |
| 7,540,728 | B2 | 6/2009 | Gorban |
| 7,549,850 | B2 | 6/2009 | Trapalis |
| 7,553,138 | B2 | 6/2009 | Gorban |
| 7,726,115 | B2 | 6/2010 | Murrow et al. |
| 7,837,451 | B2 | 11/2010 | Wiedenhoefer et al. |
| 7,942,657 | B2 | 5/2011 | Gray |
| 8,033,802 | B2 | 10/2011 | Tekneyan et al. |
| 8,133,044 | B2 | 3/2012 | Wiedenhoefer et al. |
| 8,356,585 | B2 | 1/2013 | Hathaway et al. |
| 8,523,545 | B2 | 9/2013 | Wilbourn et al. |
| 8,523,546 | B2 | 9/2013 | Shkolnik et al. |
| 8,539,930 | B2 | 9/2013 | Gray |
| 8,539,931 | B1 | 9/2013 | Hanna |
| 8,888,474 | B2 | 11/2014 | Hohl et al. |
| 8,905,733 | B2 | 12/2014 | Guidry |
| 9,051,780 | B2 | 6/2015 | Trushin |
| 9,228,590 | B2 | 1/2016 | Nachtergaele et al. |
| 10,001,123 | B2 * | 6/2018 | Kreuger ..... F04C 29/0057 |
| 10,087,758 | B2 | 10/2018 | Montie et al. |
| 10,837,444 | B2 | 11/2020 | Montie et al. |
| 10,844,720 | B2 | 11/2020 | Montie |
| 10,844,859 | B2 | 11/2020 | Montie et al. |
| 11,286,928 | B2 | 3/2022 | Krampe et al. |
| 11,499,550 | B2 | 11/2022 | Montie et al. |
| 11,802,558 | B2 | 10/2023 | Montie et al. |
| 11,815,094 | B2 | 11/2023 | Montie et al. |
| 2002/0122722 | A1 | 9/2002 | Bertin et al. |
| 2003/0102629 | A1 | 6/2003 | Bhate et al. |
| 2005/0017053 | A1 | 1/2005 | Sbarounis |
| 2006/0073032 | A1 | 4/2006 | Parrett |
| 2006/0127259 | A1 | 6/2006 | Gorban |
| 2006/0233653 | A1 | 10/2006 | Trapalis |
| 2008/0031758 | A1 | 2/2008 | Rosam et al. |
| 2008/0193309 | A1 | 8/2008 | Kothnur et al. |
| 2009/0110579 | A1 | 4/2009 | Amburgey |
| 2009/0220369 | A1 | 9/2009 | Wiedenhoefer et al. |
| 2009/0241536 | A1 | 10/2009 | Gale et al. |
| 2010/0183454 | A1 | 7/2010 | Lübke et al. |
| 2011/0150685 | A1 | 6/2011 | Wilbourn et al. |
| 2011/0262291 | A1 | 10/2011 | Fleger et al. |
| 2012/0070326 | A1 | 3/2012 | Hammerbeck |
| 2012/0156078 | A1 | 6/2012 | Guidry |
| 2012/0177484 | A1 | 7/2012 | Lusted et al. |
| 2012/0240885 | A1 | 9/2012 | Horn |
| 2013/0028775 | A1 | 1/2013 | Gekht et al. |
| 2013/0064702 | A1 | 3/2013 | Hohl et al. |
| 2014/0170011 | A1 | 6/2014 | Clouzeau et al. |
| 2014/0286808 | A1 | 9/2014 | Kachele |
| 2015/0030492 | A1 | 1/2015 | Montie et al. |
| 2016/0017711 | A1 | 1/2016 | Morris |
| 2016/0141921 | A1 | 5/2016 | Kubes |
| 2017/0074100 | A1 | 3/2017 | Jarvis et al. |
| 2017/0137005 | A1 | 5/2017 | Weh et al. |
| 2017/0321697 | A1 | 11/2017 | Beinert et al. |
| 2018/0291740 | A1 | 10/2018 | Montie |
| 2018/0291900 | A1 | 10/2018 | Valkenberg et al. |
| 2020/0200008 | A1 | 6/2020 | Montie et al. |
| 2020/0200174 | A1 | 6/2020 | Montie et al. |
| 2021/0025392 | A1 | 1/2021 | Montie et al. |
| 2021/0062655 | A1 | 3/2021 | Montie et al. |
| 2021/0189880 | A1 | 6/2021 | Montie et al. |
| 2021/0199011 | A1 | 7/2021 | Montie et al. |
| 2021/0285440 | A1 | 9/2021 | Montie et al. |
| 2022/0205445 | A1 | 6/2022 | Montie et al. |
| 2022/0220958 | A1 | 7/2022 | Montie et al. |
| 2023/0098259 | A1 | 3/2023 | Montie et al. |

FOREIGN PATENT DOCUMENTS

| | | | |
|---|---|---|---|
| EP | 1552124 | A1 | 5/2006 |
| EP | 1988288 | B1 | 11/2008 |
| GB | 1542366 | A | 3/1979 |
| JP | H1010141265 | A1 | 5/1998 |
| JP | H275663124 | B1 | 2/2015 |
| PL | 173668 | B1 | 7/1994 |
| WO | 1993022631 | A1 | 11/1993 |
| WO | 1999056004 | A1 | 11/1999 |
| WO | 2005078239 | A1 | 8/2005 |

(56) References Cited

FOREIGN PATENT DOCUMENTS

| | | | |
|---|---|---|---|
| WO | 2009103528 | A2 | 10/2009 |
| WO | 2010131103 | A2 | 3/2011 |
| WO | 2018222490 | A1 | 2/2018 |

OTHER PUBLICATIONS

Wydra, L., The Development of Outer-Envelope Trochoidal Compressors, International Compressor Engineering Conference (1986), pp. 282-292.
Wrede et al., Recent Status of Trochoidal Type Compressors for Heat Pumps in Germany, International Compressor Engineering Conference (1986), pp. 254-282.
International Search Report and Written Opinion dated Nov. 13, 2019 issued in connection with International Application No. PCT/CA2019/051273.
International Search Report and Written Opinion dated Nov. 18, 2019 issued in connection with International Application No. PCT/CA2019/051274.
International Search Report and Written Opinion dated Nov. 19, 2019 issued in connection with International Application No. PCT/CA2019/051272.
International Preliminary Report on Patentability dated Mar. 9, 2021 issued in connection with International Application No. PCT/CA2019/051272.
International Preliminary Report on Patentability dated Mar. 9, 2021 issued in connection with International Application No. PCT/CA2019/051273.
International Preliminary Report on Patentability dated Mar. 9, 2021 issued in connection with International Application No. PCT/CA2019/051274.
UK Examination Report dated Mar. 1, 2022 issued in connection with Great Britain Application No. GB 2104634.7.
International Search Report and Written Opinion dated Mar. 29, 2022, issued in connection with International Application No. PCT/CA2022/050021.
Extended European Search Report issued on May 16, 2022 in connection with European Patent Application 19859949.0.
Extended European Search Report issued on Jul. 8, 2022, in connection with European Patent Application 19860104.9.
UK Examination Report dated Oct. 21, 2022, issued in connection with Great Britain Application No. GB 2104634.7.
UK Examination Report dated Jan. 19, 2023, issued in connection with Great Britain Application No. GB 2104634.7.
International Preliminary Report on Patentability issued in connection with PCT Application PCT/CA2022/050021.
Examiner's Report issue Feb. 7, 2024, in connection with Canadian Application No. 3177204.
Examiner's Report issued Feb. 15, 2024, in connection with Canadian Application No. 3112348.
Om et al., Calculation for Cross Section and Area Efficiency of Progressing Cavity Pump with Hypotrochoidal Multilobe Using the Differential Geometric Envelope Approach Journal of Petroleum Science and Engineering, Elsevier, Amsterdam, NL, vol. 171, Apr. 1, 2018, pp. 211-217.
Examiner's Report issued Aug. 9, 2024, in connection with European Patent Application 19859949.0.
Examiner's Report issued Sep. 16, 2024, in connection with European Patent Application No. 19860104.9.
Office Action issued Nov. 22, 2024, in connection with Canadian Patent Application No. 3,112,348.
Office Action issued Jan. 27, 2025, in connection with Canadian Patent Application No. 3,177,204.
Examiner's Report issued Jan. 31, 2025, in connection with European Patent Application No. 19859949.0.

* cited by examiner

PUMPS, COMPRESSORS, AND EXPANDERS WITH A TEARDROP-SHAPED ROTOR

CROSS-REFERENCE TO RELATED APPLICATIONS

This application is a continuation of and claims priority benefits from International application No. PCT/CA2022/050021 filed on Jan. 7, 2022, entitled, "Rotary Machines With Teardrop-Shaped Rotors" which, in turn claims priority benefits from U.S. Provisional Patent Application Ser. No. 63/135,069 filed Jan. 8, 2021, entitled "Helical Trochoidal Rotary Machines With Improved Solids Handling", and from U.S. Provisional Patent Application Ser. No. 63/144,200 filed Feb. 1, 2021, entitled "Rotary Machines With Teardrop-Shaped Rotors".'

This application also claims priority from the '069 and '200 applications. The '021, '069 and '200 applications are incorporated by reference herein in their entireties.

FIELD OF THE INVENTION

The present invention relates to rotary positive displacement machines, where the machines are based on trochoidal geometry or offset trochoidal geometry and it is the inner profile of the stator that is hypotrochoidal or nearly hypotrochoidal in cross-section. In some embodiments the cross-sectional profile of the stator cavity is an ellipse or outwardly-offset ellipse, and the rotor has a teardrop-shaped cross-sectional profile. In some embodiments, the machines comprise a helical rotor that undergoes planetary motion relative to a helical stator. In some embodiments, the machines comprise a rotor seal.

Rotary machines, in which at least one rotor has planetary motion within a stator or housing, can be employed, for example, as positive displacement pumps, rotary compressors, vacuum pumps, expansion engines, and the like.

Pumps are devices that can move a working fluid from one place to another. There is a wide range of end uses for various types of pumps, including irrigation, fire-fighting, flood control, water supply, gasoline supply, refrigeration, chemical movement and sewage transfer. Rotary pumps are typically positive displacement pumps comprising a fixed housing, gears, cams, rotors, vanes and/or similar elements. Rotary pumps usually have close running clearances (only a small distance or gap between their moving and stationary parts), typically do not require suction or discharge valves, and are often lubricated only by the fluid being pumped.

A positive displacement pump moves fluid by trapping a volume of fluid in a chamber and forcing the trapped volume into a discharge pipe. Some positive displacement pumps employ an expanding chamber on the suction side and a decreasing chamber on the discharge side. Fluid flows into the pump intake as the chamber on the suction side expands, and the fluid flows out of the discharge pipe as the chamber collapses. The output volume is the same for each cycle of operation. An ideal positive displacement pump can produce the same flow rate at a given pump speed regardless of the discharge pressure.

Various classes of rotary machines are based on trochoidal geometries. Such rotary machines can comprise a rotor or stator whose cross-section is bounded by a certain family of curves, known as trochoids or trochoidal shapes. These include machines with the following configurations:

(1) rotary machines in which the rotor is hypotrochoidal in cross-section, and undergoes planetary motion (spins about its axis and orbits eccentrically) within a stator that is shaped as an outer envelope of that rotor (with the rotor having one more apex or lobe than the stator cavity);

(2) rotary machines in which the stator cavity is hypotrochoidal in cross-section, and the rotor undergoes planetary motion within the stator and is shaped as the inner envelope of that stator (with the rotor having one less apex or lobe than the stator cavity);

(3) rotary machines in which the rotor is epitrochoidal in cross-section, and undergoes planetary motion within a stator that is shaped as an outer envelope of that rotor (with the rotor having one less apex or lobe than the stator cavity); and (4) rotary machines in which the stator cavity is epitrochoidal in cross-section, and the rotor undergoes planetary motion within the stator and is shaped as the inner envelope of that stator (with the rotor having one more apex or lobe than the stator cavity).

Thus, in these configurations, the rotor or stator is a trochoidal component, meaning it has a cross-sectional shape that is a trochoid.

Rotary machines where the rotor has a cross-sectional shape that is hypotrochoidal, and the stator cavity is shaped as an outer envelope of the rotor as it undergoes planetary motion are described in U.S. Pat. No. 10,087,758 which is incorporated by reference herein. Rotary machines with trochoidal geometries that comprise a helical rotor that undergoes planetary motion within a helical stator are described in U.S. Pat. Nos. 10,837,444 and 10,844,859 which are both incorporated by reference herein. In some embodiments, for example, with a rotor having an elliptical or near elliptical cross-section there are two, or at times three, sealing points between the rotor and stator as they move relative to each other, and every point of the rotor and stator surfaces are swept. The inverse apex of the stator cavity is a contact or sealing point, as are the two tips of the rotor. It has been found that an interference fit is not required for at least some pumps of this design, however in some embodiments an elastomeric stator is used. In other embodiments one or more seals are used (for example, at the inverse apex of the stator, and/or at the rotor tips) to improve the performance of the pump.

Generally, as used herein, an object is said to undergo "planetary motion" when it spins about one axis and orbits about another axis.

Rotary machines, such as those described above, can be designed for various applications including, for example, as pumps, compressors, and/or expansion engines. The design, configuration and operation of different rotary machines can offer particular advantages for certain applications.

Progressive cavity pumps (PCPs) are another type of rotary positive displacement machine that can offer advantages for certain applications. In PCPs, a rotor is disposed and rotates eccentrically within a helical stator cavity. The material to be pumped (typically a fluid) follows a helical path along the pump axis. The rotor is typically helical with a circular transverse cross-section displaced from the axis of the helix and defines a single-start thread. The corresponding stator cavity is a double helix (two-start thread) with the same thread direction as the rotor, and in transverse cross-section has an outline defined by a pair of spaced apart semi-circular ends joined by a pair of parallel sides. The pitch (the axial distance between adjacent threads) of the stator is the same as the pitch of the rotor, and the lead of the stator (the axial distance or advance for one complete turn) is twice that of the rotor.

In PCPs, the rotor generally seals tightly against the stator as it rotates within it, forming a series of discrete fixed-shape, constant-volume chambers between the rotor and stator. The fluid is moved along the length of the pump within the chambers as the rotor turns relative to the stator. The volumetric flow rate is proportional to the rotation rate. The discrete chambers taper down toward their ends and overlap with their neighbors, so that the flow area is substantially constant and in general, there is little or no flow pulsation caused by the arrival of chambers at the outlet. The shear rates are also typically low in PCPs in comparison to those in other types of pumps. In PCPs, where the rotor touches the stator, the contacting surfaces are generally traveling transversely relative to one another, so small areas of sliding contact occur. The rotor is typically formed of rigid material and the stator (or stator lining) of resilient or elastomeric material to facilitate sealing in the PCP. Elastomers are not generally thermally stable at high temperatures and they can react with or be degraded by some fluids. Therefore, for some applications an elastomeric stator cannot be used, and there is reliance on two metal surfaces sealing against each other. In such cases hard metals with good abrasion resistance are typically used for the rotor and stator, but wear and a lack of longevity can still be a problem. The location of most friction/wear in PCPs is generally where the rotor pockets into the end of the stator slot instantaneously contacting with great force the entire semi-circular rotor end into the half circular stator.

SUMMARY OF THE INVENTION

In a first set of embodiments, a rotary machine comprises a stator having a stator cavity and a rotor disposed within the stator cavity. The rotor has a helical profile, and a rotor axis, and a rotor shape in cross-section transverse to the rotor axis along at least a portion of a length of the rotor that is a teardrop shape. The stator cavity has a helical profile, a stator axis, and having a stator shape at any cross-section transverse to the stator axis along at least a portion of a length of the stator cavity that is an outer envelope formed when the teardrop rotor shape undergoes planetary motion. The rotary machine is configured so that, in operation of the rotary machine, the rotor undergoes planetary motion relative to the stator. In some embodiments the stator shape is an outwardly-offset ellipse. In other embodiments the stator shape is an ellipse.

In some embodiments of the first set of embodiments, the rotary machine includes a helical dynamic rotor seal mounted on the rotor.

In some embodiments of the first set of embodiments, the rotary machine has a geometry characterized by a radius R, an offset O and an eccentricity E, wherein E is the distance between the rotor axis and the stator axis, O is greater than zero, R is greater than E. In some embodiments where the stator shape is an outwardly-offset ellipse $R+O=3E$. In some where the stator shape is an outwardly-offset ellipse $R+O>3E$. In some embodiments where the stator shape is an ellipse $R=3E$. In some where the stator shape is an ellipse $R>3E$.

In some embodiments of the first set of embodiments, the rotary machine is configured so that, in operation of the rotary machine, the rotor spins about the rotor axis and orbits about the stator axis within the stator cavity. In some embodiments of the first set of embodiments, the rotary machine is configured so that, in operation of the rotary machine, the stator spins about the stator axis and orbits about the rotor axis. In some embodiments of the first set of embodiments, the rotary machine is configured so that, in operation of the rotary machine, the rotor spins about the rotor axis and the stator spins about the stator axis, and the rotor and stator are held at a fixed eccentricity in space.

In some embodiments of the first set of embodiments, rotary machine of is a multi-stage machine having a plurality of chambers between (and defined by) cooperating fluid-facing surfaces of the rotor and the stator. In some embodiments, each of the plurality of chambers has approximately the same volume. In some embodiments, each of the plurality of chambers has different dimensions. In some embodiments, each of the plurality of chambers has a different volume. In some embodiments, the pitch of the rotor and the stator varies along at least a portion of the length the rotor and stator, respectively. In some embodiments, rotor axis is inclined relative to the stator axis.

In some embodiments of the first set of embodiments, the rotary machine is a pump. In some embodiments of the first set of embodiments, the rotary machine is a compressor or an expander.

In a second set of embodiments, a rotary machine comprises a stator having a stator cavity and a rotor disposed within the stator cavity. The rotor has a rotor axis and a teardrop-shaped rotor cross sectional profile transverse to the rotor axis. The stator cavity has a stator axis, and a stator cross-sectional profile transverse to the stator axis that is an outwardly offset ellipse. The stator cross-sectional profile is an outer envelope formed when the teardrop-shaped rotor cross sectional profile undergoes planetary motion. The rotary machine is configured so that, in operation of the rotary machine, the rotor undergoes planetary motion relative to the stator.

In some embodiments of the second set of embodiments, the rotary machine further comprises a dynamic seal mounted on said rotor.

In some embodiments of the second set of embodiments, the rotary machine has a geometry characterized by a radius R, an offset O and an eccentricity E, wherein E is the distance between the rotor axis and the stator axis, O is greater than zero, R is greater than E. In some embodiments $R+O=3E$. In some embodiments $R+O>3E$.

In some embodiments of the second set of embodiments, the rotary machine is configured so that, in operation of the rotary machine, the rotor spins about the rotor axis and orbits about the stator axis within the stator cavity. In some embodiments of the second set of embodiments, the rotary machine is configured so that, in operation of the rotary machine, the stator spins about the stator axis and orbits about the rotor axis. In some embodiments of the second set of embodiments, the rotary machine is configured so that, in operation of the rotary machine, the rotor spins about the rotor axis and the stator spins about the stator axis, and the rotor and stator are held at a fixed eccentricity in space.

In some embodiments of the second set of embodiments, the rotary machine is a pump.

In a third set of embodiments, a rotary machine comprises a stator having a stator cavity and a rotor disposed within the stator cavity. The rotor has a rotor axis and a teardrop-shaped rotor cross sectional profile transverse to the rotor axis. The stator cavity has a stator axis, and a stator cross-sectional profile transverse to the stator axis that is an outwardly offset ellipse. The stator cross-sectional profile is an outer envelope formed when the teardrop-shaped rotor cross sectional profile undergoes planetary motion. The rotary machine is configured so that, in operation of the rotary machine, the rotor undergoes planetary motion relative to the stator. The rotary machine includes a dynamic rotor seal mounted on the rotor.

In some embodiments of the third set of embodiments the rotary machine has a geometry characterized by a radius R and an eccentricity E, wherein E is the distance between the rotor axis and the stator axis, R is greater than E. In some embodiments, R=3E. In some embodiments, R>3E.

In some embodiments of the third set of embodiments, the rotary machine is configured so that, in operation of the rotary machine, the rotor spins about the rotor axis and orbits about the stator axis within the stator cavity. In some embodiments of the third set of embodiments, the rotary machine is configured so that, in operation of the rotary machine, the stator spins about the stator axis and orbits about the rotor axis. In some embodiments of the third set of embodiments, the rotary machine is configured so that, in operation of the rotary machine, the rotor spins about the rotor axis and the stator spins about the stator axis, and the rotor and stator are held at a fixed eccentricity in space.

In some embodiments of the third set of embodiments, the rotary machine is a pump.

DETAILED DESCRIPTION OF ILLUSTRATIVE EMBODIMENT(S)

The present disclosure relates to, among other things, rotary machines in which a rotor undergoes planetary motion relative to a stator. This includes machines in which the stator is fixed (not moving) and the rotor spins about its longitudinal axis and orbits within the stator; machines in which the rotor is fixed and the stator spins and orbits; and machines in which the eccentric radius of the planetary motion is fixed and the rotor and stator both spin about their respective longitudinal axes. In some embodiments, the rotary machines are based on trochoidal geometries, and in some embodiments the rotary machines are based on offset trochoidal geometries, with the stator cavity having a hypotrochoidal geometry or offset hypotrochoidal geometry (in transverse cross-section, i.e. perpendicular to its axis).

A hypotrochoid is a roulette (or curve) traced by a point attached to a circle of radius r rolling (without slipping) around the inside of a fixed circle of radius L, where the point is at a distance d from the center of the interior circle. In some particular cases, an ellipse is formed when L=2r and d>r or d<r (d≠r).

Figure 1A:
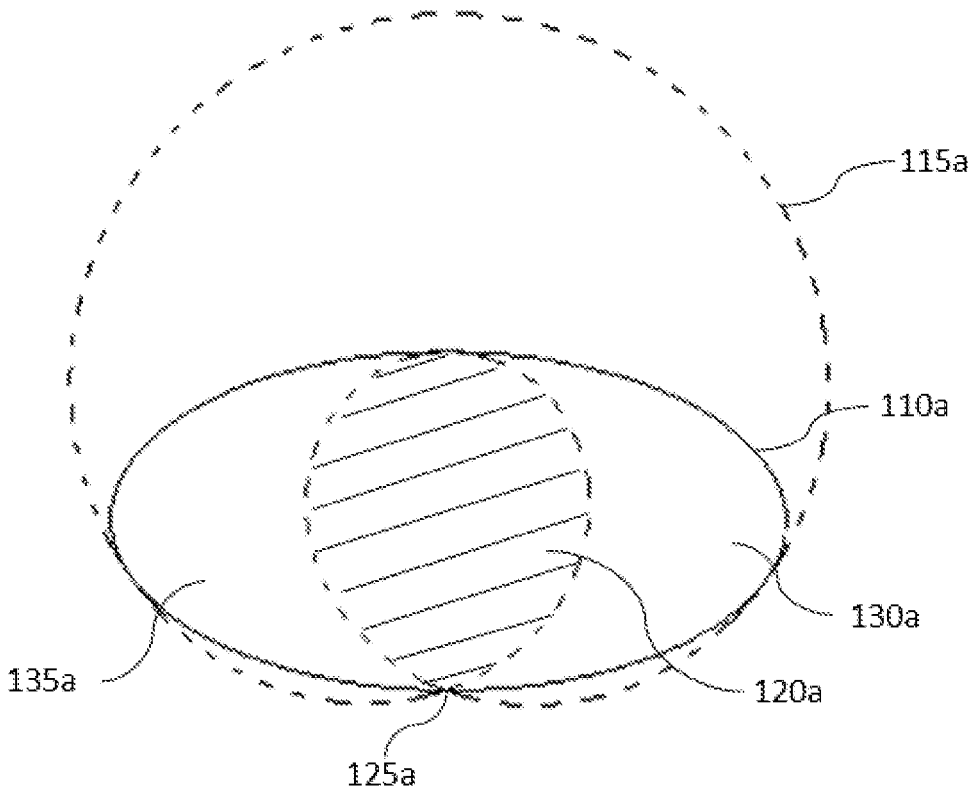
FIG. 1A is a schematic diagram illustrating geometry on which certain embodiments of rotary machines are based.

FIG. 1A shows ellipse 110*a*. Ellipse 110*a* can represent the shape of a stator cavity in transverse cross-section. If the ellipse undergoes planetary motion, as if driven via a sun gear with radius r and a ring gear with radius 2r (arranged the same way as the circles of radius r and 2r used to generate the ellipse), the swept area from this motion of this ellipse is a limaçon with an inner loop, shown in FIG. 1A as dashed line 115*a*. The portion of limaçon 115*a* that falls within ellipse 110*a* (shown as teardrop-shaped region 120*a* with diagonal shading in FIG. 1A) can define the transverse cross-sectional shape of a rotor. Region 120*a* comes to a sharp point 125*a*.

Figure 1B:
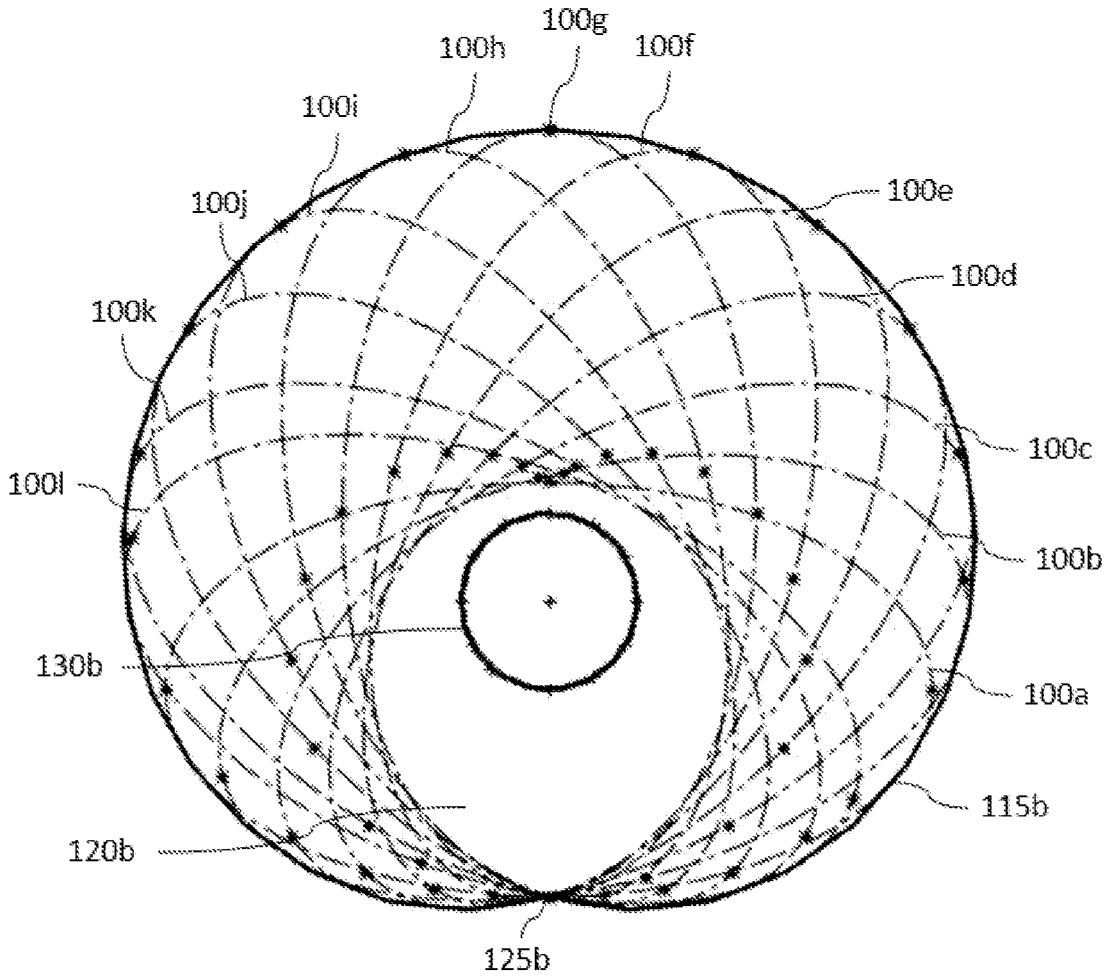
FIG. 1B is a schematic diagram illustrating the profile generated by an ellipse as it undergoes planetary motion.

By way of further explanation of this geometry, FIG. 1B is a schematic diagram illustrating the profile generated by an ellipse (which can, for example, represent the cross-sectional shape of a stator cavity) as it undergoes planetary motion. Ellipse profiles 100*a*-100*l* show various orientations of ellipse 100 during this motion. The outer envelope of profiles 100*a*-100*l*, and all intervening profiles that could be generated by the motion of the ellipse, describe outer shape 115*b*.

Circle 130*b* is the locus of the instantaneous center of rotation of the ellipse. Region 120*b* is a teardrop-shaped region having no ellipse profile lines falling within it. If ellipse 100 represents a stator cavity, region 120*b* represents a space that is never occupied by the stator itself during the planetary motion of the stator—it is always an open space. Hence a rotor having a teardrop-shaped cross-section (with pointed tip 125*b*) can be disposed within such an elliptical stator cavity and can undergo planetary motion within the stator cavity.

As seen in FIG. 1A, if ellipse 110*a* represented the cross-sectional shape of a stator cavity, and region 120*a* represented the cross-sectional shape of a rotor within that stator cavity, in this position of the rotor there are two separate chambers, 130*a* and 135*a*, between the rotor and stator within which there could be fluid. In some positions of the rotor relative to the stator there are three fluid chambers between the rotor and stator. When the rotor undergoes planetary motion relative to the stator, the fluid volume in both chambers is reduced and it is in this way that, with suitably placed inlets, outlets and/or other features, a rotary machine based on this geometry can pump a fluid and/or be used for other hydromechanical applications.

With this arrangement (assuming a contact fit between rotor and stator shapes) the tip of the rotor, represented by point 125*a* in FIG. 1A, is in contact with the inner surface of the stator at all positions of the rotor as it undergoes planetary motion relative to the stator.

Figure 1C:
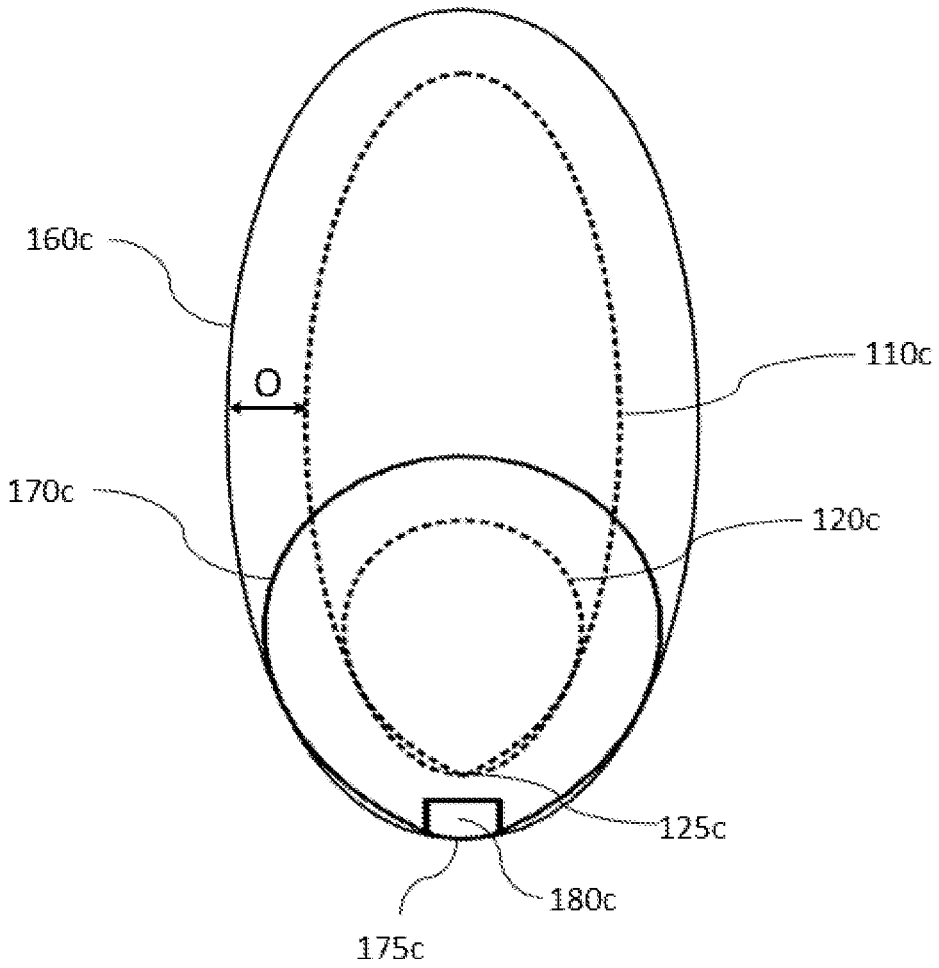
FIG. 1C is a diagram representing a rotor-stator assembly in transverse cross-section, illustrating modified geometry on which certain embodiments of rotary machines are based.

In some embodiments, rotary machines are based on a modification to the above-described geometry, as illustrated in the diagram shown in FIG. 1C. Instead of being a true ellipse such as shown in FIG. 1C as dashed line 110*c*, the stator cavity transverse cross-sectional profile can be an offset ellipse, shown in FIG. 1C as 160*c*, generated by outwardly offsetting each point on an ellipse by a fixed distance or offset "O" measured perpendicular to a tangent to the ellipse at that point. With this offset applied, the resulting rotor shape 170*c* (generated as described above) no longer comes to a sharp point at any part of its perimeter. Without the offset, the rotor shape is shown in FIG. 1C with dashed line 120*c* and has sharp tip 125*c*. With the offset geometry, the tip 175*c* of the rotor teardrop shape is more rounded. FIG. 1C shows region 180*c* where a rotor seal can be mounted. A result of the offset geometry and having a more rounded region of the teardrop-shaped rotor surface being in contact with the stator, is that there tends to be less contact pressure between the components, and they are less susceptible to wear. Thus, offsetting both the stator and rotor profiles, as described, can broaden the sharp features to a more rounded profile, which reduces wear that tends to occur with sharp contact points.

In "straight" or "linear" embodiments of rotary machines having such an offset geometry, the transverse cross-sectional profile of the stator cavity is an outwardly-offset ellipse and the stator cavity is shaped as a prism where the base shape is the outwardly-offset ellipse; the rotor transverse cross-sectional profile is a teardrop with a rounded tip and the rotor is shaped as a prism where the base shape is the rounded teardrop.

Figure 2A:
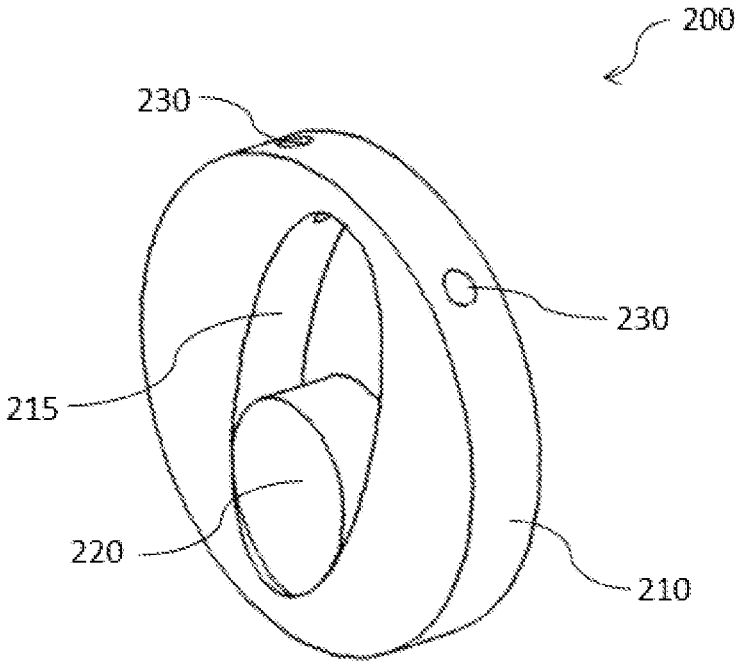
FIG. 2A is a perspective view of an embodiment of a rotor-stator assembly for a linear rotary machine.
Figure 2B:
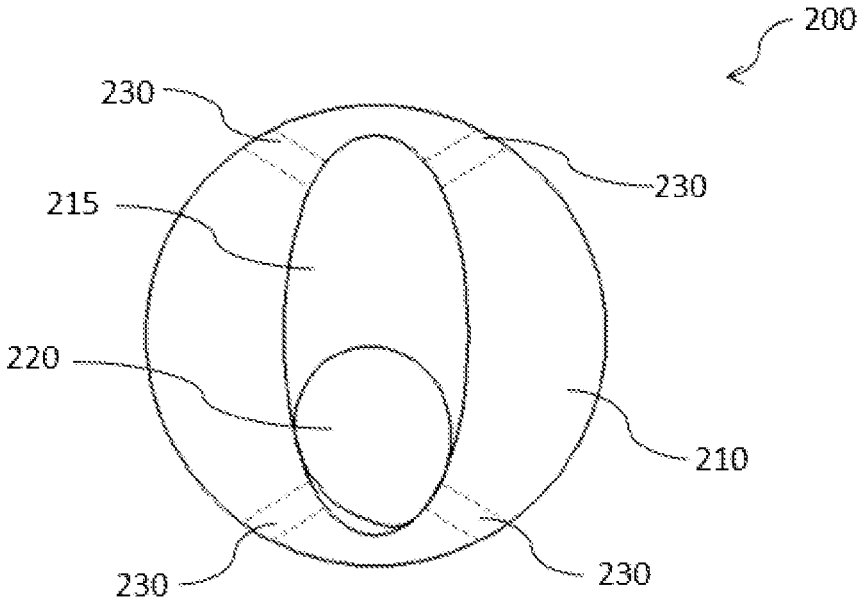
FIG. 2B is a cross-sectional end view of the rotor-stator assembly of FIG. 2A.

FIG. 2A and FIG. 2B illustrate an embodiment of a rotor-stator assembly 200 for a linear rotary machine. Rotor 220 has a teardrop-shaped profile, and is positioned inside stator 210 where the transverse cross-sectional profile of stator cavity 215 is an outwardly-offset ellipse. Rotor-stator assembly 200 includes four fluid inlet/outlet ports or openings 230 formed in stator 210 that can be suitably configured so that the rotary machine can be used, for example, as a pump.

In some embodiments, the machine geometries described above are employed in rotary machines in which the rotor and stator transverse cross-sectional profiles are each swept along helical paths, the axes of those helices being the axes of rotation of those components in a reference frame in which both parts undergo simple rotary motion (the "centers" of those components). In these embodiments, the rotor and the stator cavity are twisted along their axes, rather than being straight or linear. The axes of the rotor and stator helices are offset from one another by a distance equal to the eccentricity (E) of the rotor.

Thus, in some embodiments the inner surface of a helical stator cavity is defined by an ellipse, or preferably an outwardly-offset ellipse, swept along a helical path, and a corresponding rotor is defined by sweeping the corresponding teardrop shape along a helical path with half the lead of the helical stator cavity. The helical rotor and corresponding stator have the same pitch. The rotor profile is a single-start helix, and so the pitch of the rotor is the same as the lead of the rotor. The stator profile is a double-start helical cavity, and so the lead of the rotor is half the lead of the stator.

As used herein, "pitch" is defined as the axial distance between adjacent threads (or crests or roots, for example, on a helix), and "lead" is defined as the axial distance or advance for one complete turn (360°). Pitch and lead are equal with single start helices; for multiple start helices the lead is the pitch multiplied by the number of starts.

For such machines, when a transverse cross-section is taken in any plane perpendicular to the axis of rotation (of the rotor and/or stator), the outer profile of the rotor and inner profile of the stator (that is, the cross-sectional shape of the rotor and the stator, respectively) is similar to those illustrated in FIG. 1A and/or FIG. 1C.

Figure 3A:
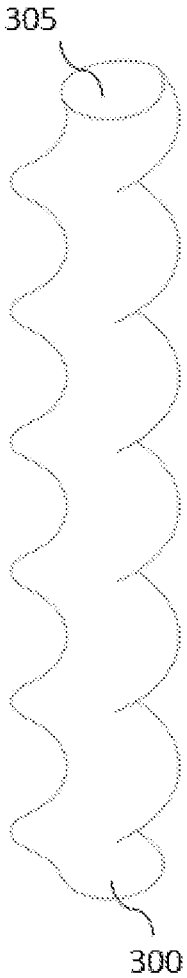
FIG. 3A is an isometric view of a helical rotor with teardrop-shaped transverse cross-section.
Figure 3B:
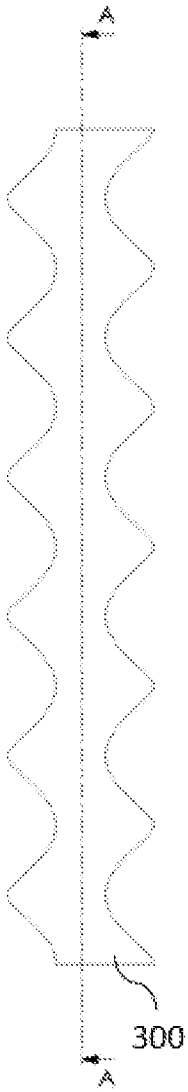
FIG. 3B is a side view of the helical rotor of FIG. 3A, viewed perpendicular to the axis of the rotor.
Figure 3C:
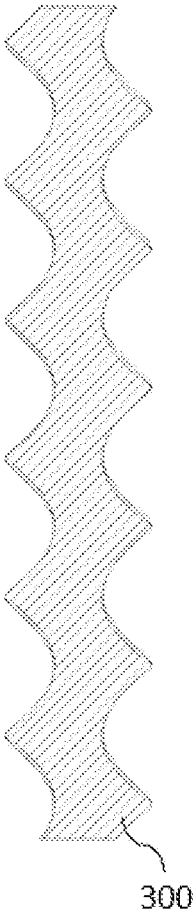
FIG. 3C is a cross-sectional view of the helical rotor of FIG. 3A taken in the direction of arrows A-A in FIG. 3B.

FIG. 3A shows helical rotor 300, with teardrop-shaped transverse cross-section 305. FIG. 3B is a side view of helical rotor 300, perpendicular to the longitudinal axis of helical rotor 300. FIG. 3C shows a cross-sectional view of helical rotor 300 taken in the direction of arrows A-A in FIG. 3B.

Figure 4A:
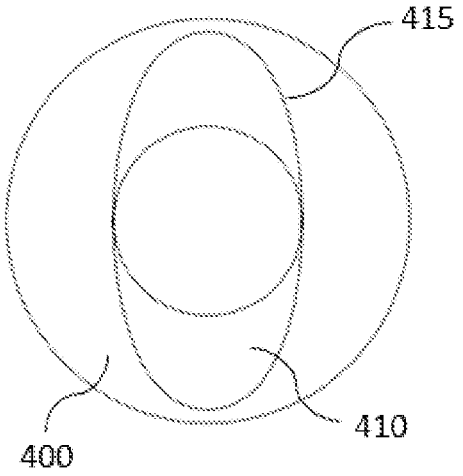
FIG. 4A is an end view of a stator with a helical cavity.
Figure 4B:
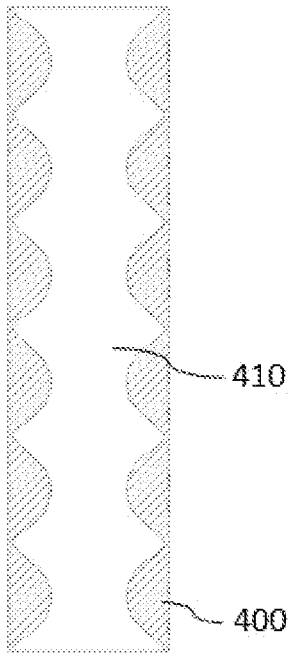
FIG. 4B is a transverse cross-sectional view of the stator of FIG. 4A.
Figure 4C:
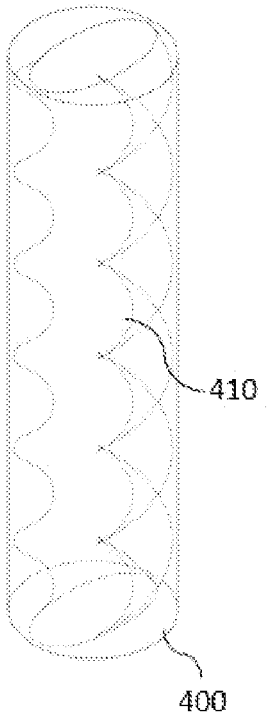
FIG. 4C is a perspective view of the stator of FIG. 4A, with the dashed line indicating the stator cavity.

FIG. 4A and FIG. 4B illustrate stator 400 with helical inner cavity 410 having cross-sectional profile 415 that is an ellipse or an outwardly-offset ellipse. The outer surface of stator in this example is cylindrical. FIG. 4C shows stator 400 with the dashed line indicating the stator cavity. In the illustrated embodiment, stator 400 corresponds to rotor 300 of FIGS. 3A-C (in other words stator 400 can be used with rotor 300).

Figure 5A:
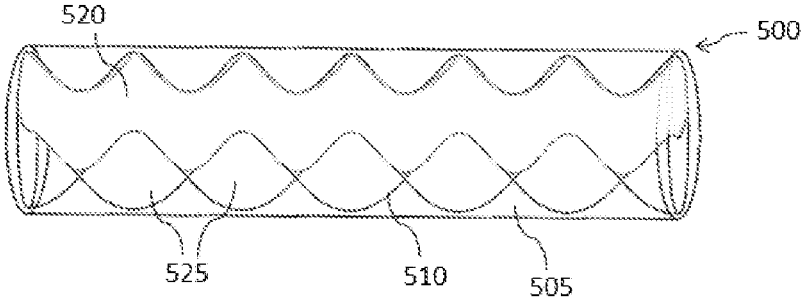
FIG. 5A is a sectional perspective view of an embodiment of a rotor-stator assembly, including a helical rotor with a teardrop-shaped transverse cross-sectional profile, and a helical stator cavity with a transverse cross-sectional profile that is an outwardly-offset ellipse.
Figure 5B:
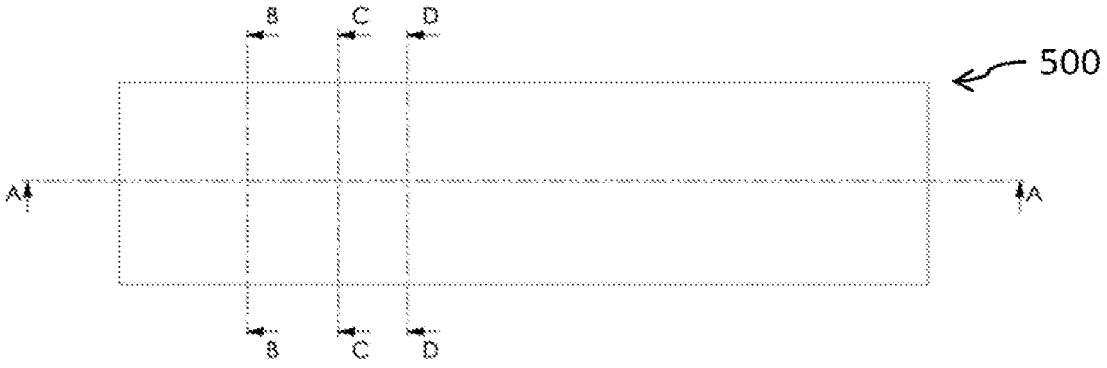
FIG. 5B is a side view of the rotor-stator assembly of FIG. 5A.
Figure 5C:
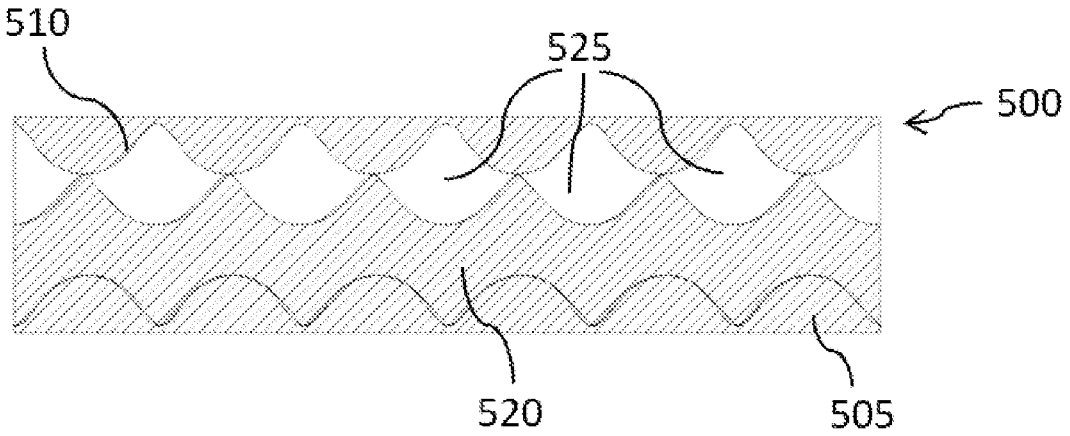
FIG. 5C is a cross-sectional view of the rotor-stator assembly of FIG. 5A taken in the direction of arrows A-A in FIG. 5B, showing a helical rotor disposed within a helical stator cavity.
Figure 5D:
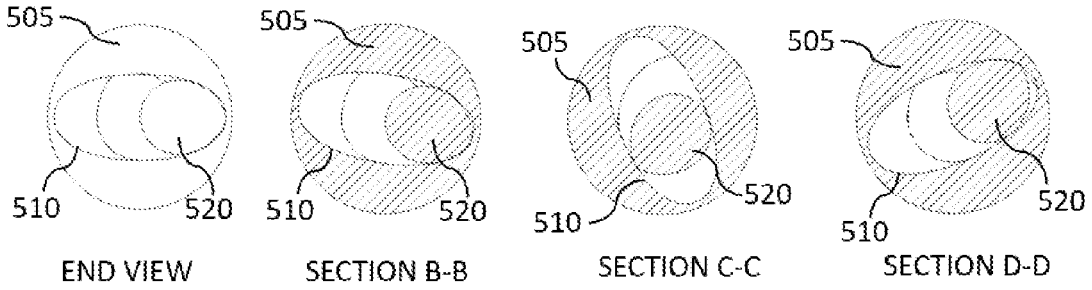
FIG. 5D shows an end view and three cross-sectional views taken in the direction of arrows B-B, C-C and D-D in FIG. 5B.

FIG. 5A illustrates an embodiment of rotor-stator assembly 500 where stator 505 and rotor 520 are similar to those illustrated in FIGS. 4A-C and FIGS. 3A-C, respectively. The inner surface of stator 505 defines a helical stator cavity 510 and a plurality of fluid chambers 525 are defined between helical stator cavity 510 and helical rotor 520. In the illustrated embodiment, the exterior surface of stator 505 is cylindrical. FIG. 5B is a side view of rotor-stator assembly 500. FIG. 5C is a cross-sectional view taken in the direction of arrows A-A in FIG. 5B and shows helical rotor 520 disposed within helical stator cavity 510 defined by stator 505, with fluid chambers 525 between rotor 520 and stator 505. FIG. 5D illustrates various transverse cross-sectional views of rotor-stator assembly 500 taken in the direction of arrows B-B, C-C and D-D in FIG. 5B. In the illustrated embodiment. helical stator cavity 510 has a cross-sectional profile that is an ellipse or an outwardly-offset ellipse. As the cross-sections B-B, C-C and D-D progress along the axis of rotation of rotor 520, the cross-sectional profile of the rotor and stator progresses in a manner analogous to motion over time of rotor 520 within or relative to helical stator cavity 510.

In embodiments of the rotary machines described herein that have a helical rotor and stator, as the rotor undergoes planetary motion relative to the stator, fluid chambers along the length of the machine can move fluid across a pressure differential (for example, from the low-pressure end of a pump to the high-pressure end) without the entire pressure differential across the machine acting across a single seal line. This is in contrast to linear (i.e. non-helicized) rotary machine embodiments where, for nearly all positions of the rotor relative to the stator, there are only two fluid chambers and a just single sealing point or region between the inlet and outlet of the pump. For example, see fluid chambers 130*a* and 135*a* and point 125*a* in FIG. 1A.

One advantage of linear and/or helical rotary machines that are based on the geometries described herein is that the orbit speed of the rotor (relative to the stator) is reduced by a factor of two relative to some other rotary machines that are based on trochoidal geometry, and (like a PCP) they have a 1:1 spin/orbit rate ratio, rather than a 1:2 spin/orbit rate ratio. A reduced orbit speed can result in a reduction in centrifugal forces which can, in turn, reduce the magnitude of centrifugal forces that the associated hardware (for example, pump supports and drive rod) must tolerate. Rotor spin rate is the rate of rotation of the rotor about its axis and, in some embodiments, spinning the rotor is how the machine is driven. Orbit is the eccentric motion of the rotor relative to the stator which is generally more responsible for vibration. In at least some embodiments of machines where there is eccentric motion of the rotor and/or stator, a lower orbit rate is preferred (for a given pump output) because it typically results in reduced vibration. Vibration can limit the operational speed of some rotary machines.

In at least some embodiments of linear rotary machines described herein, as well as the rotor contacting the stator at the tip of the teardrop-shaped rotor, the rotor also contacts the stator on the base of the rotor (the opposite more rounded end) of the teardrop-shaped rotor. However, the contact between the base of the rotor and the stator is a rolling contact with little or no sliding contact and/or motion. Similarly, in at least some embodiments of helical rotary machines, there is rolling contact (rather than sliding contact) between this region of the helical rotor and the inner surface of the stator. This can result in reduced friction and less tendency for the parts to wear. In PCPs, and in some rotary machines that are based on trochoidal geometry, there is sliding contact between the rotor and the stator rather than rolling contact.

Yet another benefit of linear rotary machines and helical rotary machines that are based on the geometries described herein (for example, having a rotor with a teardrop-shaped cross-sectional profile and a stator cavity with a cross-sectional profile that is an ellipse or outwardly-offset ellipse) is that, in at least some embodiments, a single dynamic single seal can be used to reduce or prevent fluid slip between the rotor and stator. This is because there is a single point or continuous region of the rotor surface that is in contact or in close proximity with the stator during operation of the machine. Therefore, a dynamic a seal can be provided at the tip of the teardrop-shaped rotor (in linear embodiments) or along the helical crest of the single-start helical rotor (in helical embodiments).

In contrast, in conventional progressive cavity pumps there is no point or continuous region of constant contact between the rotor and the stator, so providing sealing between the rotor and stator can be more challenging. In machines where the rotor is a double-start helical rotor, typically two rotor seals would be used. Most rotary machines do not have a constantly contacting sealing point or region, so they require more seals or larger seal area. Some rotary machines do have a constantly contacting sealing point or region, but only on the stator. It is generally much easier to provide one or more seals on a rotor than inside the cavity of a stator, particularly in helical embodiments.

Figure 6A:
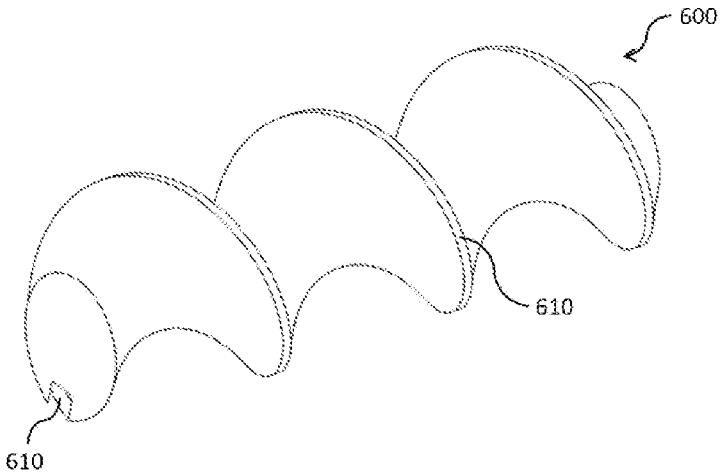
FIG. 6A is an isometric view of an embodiment of a helical rotor having a groove to accommodate a seal along the crest of the rotor.
Figure 6B:
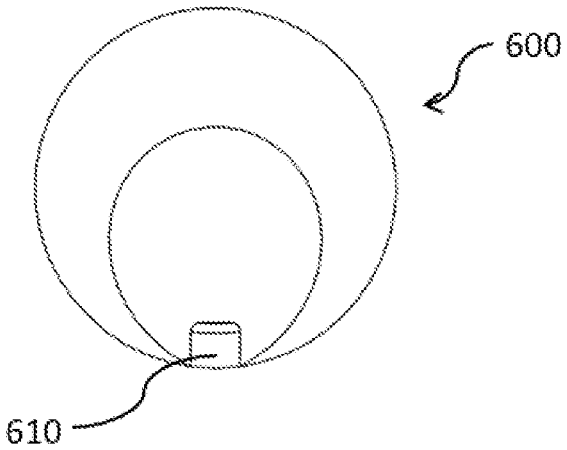
FIG. 6B is an end view of the rotor of FIG. 6A.
Figure 6C:
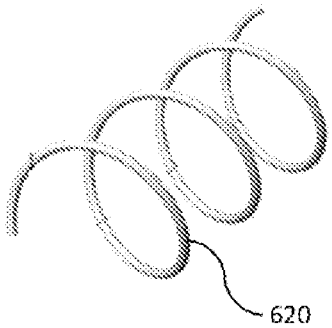
FIG. 6C is an isometric view of an embodiment of a seal that can be mounted on a helical rotor, such as the rotor illustrated in FIGS. 6A and 6B.
Figure 7A:
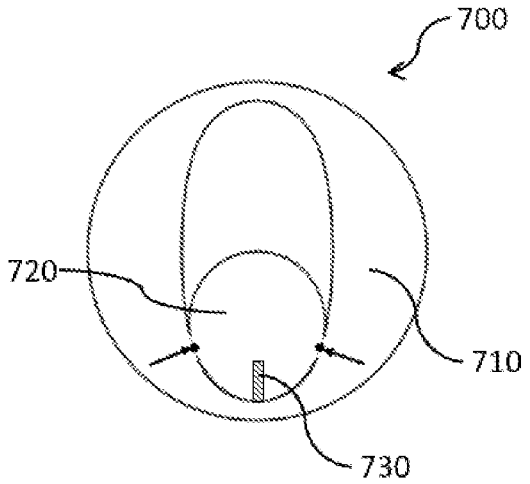
FIGS. 7A-D are transverse cross-sectional views taken at successive points along the axis of a helical rotor-stator assembly with the rotor in a fixed position relative to the stator.
Figure 7B:
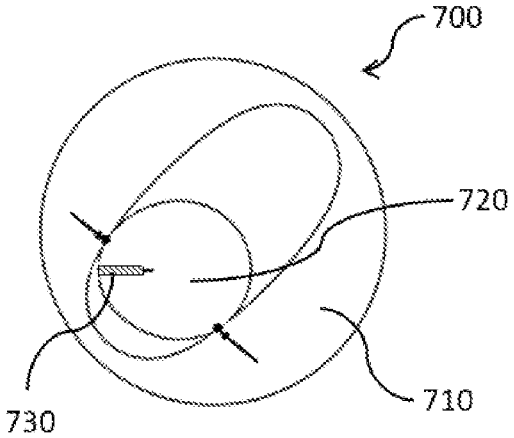
Figure 7C:
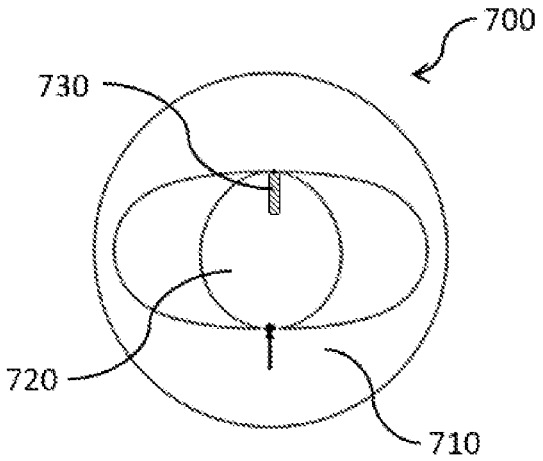
Figure 7D:
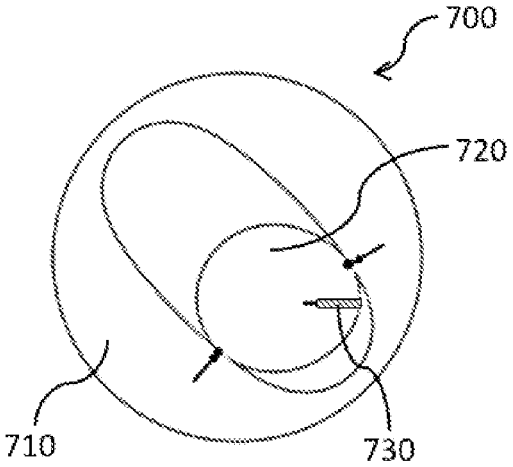

By using a rotor seal at the rotor tip or along the helical crest of the rotor, the quality of sealing between the rotor and stator can be improved. To maintain volumetric efficiency, it is generally easier to replace a rotor seal from time to time rather than having to repair or rebuild the entire high tolerance surface of a rotor/stator assembly that does not have a seal. FIG. 6A and FIG. 6B show helical rotor 600 having a teardrop-shaped cross-sectional profile and groove 610 along the crest in which a helical seal can be mounted or installed. FIG. 6C shows helical seal 620 such as could be installed in groove 610 of rotor 600.

Dynamic seals can provide high sealing efficiencies, improve solids handling, and/or extend the operating life of the machines. In addition, dynamic seals can also lower the tolerance of manufacturing of the rotor stator surfaces. In some embodiments the rotor seal is readily replaceable.

In some embodiments the seal adjusts as it wears, for example it can be a compressible over-sized seal, or a spring seal that can retract into or extend from a seal groove or channel in which it is mounted. In some embodiments this is accomplished by using a spring or rubber underneath the seal.

In some embodiments the seal on the rotor can be energized or pushed against the stator to provide a tighter seal and to self-adjust and/or compensate for wear during operation of the rotary machine. For example, a rotor seal can be made with a seal radius that is slightly too large, or oversized. The seal can be tightened (contracted radially) for installation on the rotor and will then tend to press against the interior surface of the stator, and as the rotor seal wears it will tend to expand radially (outwardly) and continue to press against the interior surface of the stator. In this way the spring-like properties of a helical rotor stator seal can be used to energize the seals, enhance the resiliency of the seals, and/or accommodate wear and thermal expansion/contraction.

The rotor seal can be made of any suitable material or combination of materials, subject to typical considerations for seal design and operation, and the nature of the working fluid. For example, softer materials can sometimes reduce the tendency for leakage, and hard materials can be more durable and less subject to wear.

Furthermore, the seal and corresponding mating feature(s) on the rotor can be designed such that the seal is held securely in place during operation of the rotary machine. The seal (and a corresponding groove on the rotor to accommodate it) can have any suitable cross-sectional profile, for example, round, square, rectangular with rounded corners, trapezoidal, stepped, tapered and the like.

Linear and helical embodiments of rotary machines having the geometries described and having a single dynamic seal on the rotor tip or along the helical rotor crest, respectively, can offer further advantages in terms of solids handling capability because of the freedom of movement of the rotor in certain directions relative to the stator. Solids handling capability relates to the capability of a rotary positive displacement machine, such as a pump, to be able transport fluids containing solids (e.g. hard particulates such as sand, fines, small rocks etc.) with a reduced tendency for jamming of the machine and/or with a reduced tendency for wear on one or more of the components of the machine.

FIGS. 7A-D show transverse cross-sectional views taken at successive points along the axis of helical rotor-stator assembly 700, with rotor 720 in a fixed position relative to stator 710. Rotor 720 is constrained on three Cartesian sides by hard contact, as indicated by the arrows in FIGS. 7A-D. On the fourth side it is constrained by dynamic seal 730. As a dynamic seal is generally resilient or compressible, this means that rotor 720 can move in a direction towards the "fourth" side compressing dynamic seal 730, thereby allowing rotor 720 to move away from stator 710 on the opposite side. In at least some embodiments, this reduces the tendency for solids to get crushed between the base (more rounded end) of the teardrop-shaped rotor and the stator. In at least some embodiments, this is further benefited by a rolling motion of the base of the rotor against the stator, rather than a sliding motion. Rolling contact generally causes less wear than sliding contact.

In at least some embodiments, a rotor seal, if used, can be designed to facilitate solids handling. For example, in some embodiments a seal is mounted asymmetrically on the rotor. In some embodiments an outer (fluid-facing) surface of a rotor seal is featured with indentations and/or protrusions. In some embodiments an outer (fluid-facing) surface of a rotor seal can include other materials, such as bristles, hairs, or broom-like features extending therefrom, and/or can include durable but flexible synthetic materials. In some embodiments a rotor seal is configured to act as a scraper during operation of the rotary machine. Similar features can be incorporated into stator seals, instead or as well, to facilitate solids handling.

Solids handling in at least some embodiments of the linear and helical rotary machines (with or without a seal on the rotor) can be further improved through the use of solids-handling features on the fluid-facing surfaces of the rotor and/or stator that can accommodate, trap and/or transport solids. In some embodiments, the solids-handling features are indentations in the rotor or stator surface. In some embodiments, it can be advantageous to incorporate such features on the base of the teardrop-shaped rotor. In some pump embodiments and end-use applications, such features can act as a temporary trap for solids. The features can provide a place for solids to go, so they are not caught or squeezed between the contact surfaces when the stator slides by the rotor as a liquid containing the solids is pumped. In some helical embodiments, the solids may exit the features and be entrained once again in the liquid as it moves along the fluid chambers created between the rotor and stator. In some embodiments and end-use applications, solids-handling features can cause additional turbulence in the flow of the fluid being pumped which can facilitate clearing of the solids from the features so that they are entrained in the fluid as the fluid moves along the chambers and are discharged from the pump (along with the fluid) at the outlet. For example, using a grooved or "rifled" rotor or stator in linear or helical pump embodiments can allow solids to be accommodated in these grooves during operation of the pump, instead of being forced between the rotor and stator surfaces where they can cause wear of pump components and/or cause the machine to jam, while still retaining acceptable pump performance (for example, with low fluid slip across seal lines). FIGS. 8-11 illustrate examples of rotor and stators, for embodiments of the rotary machines described herein, with solids-handling features on the fluid-facing surfaces thereof.

Figure 8:
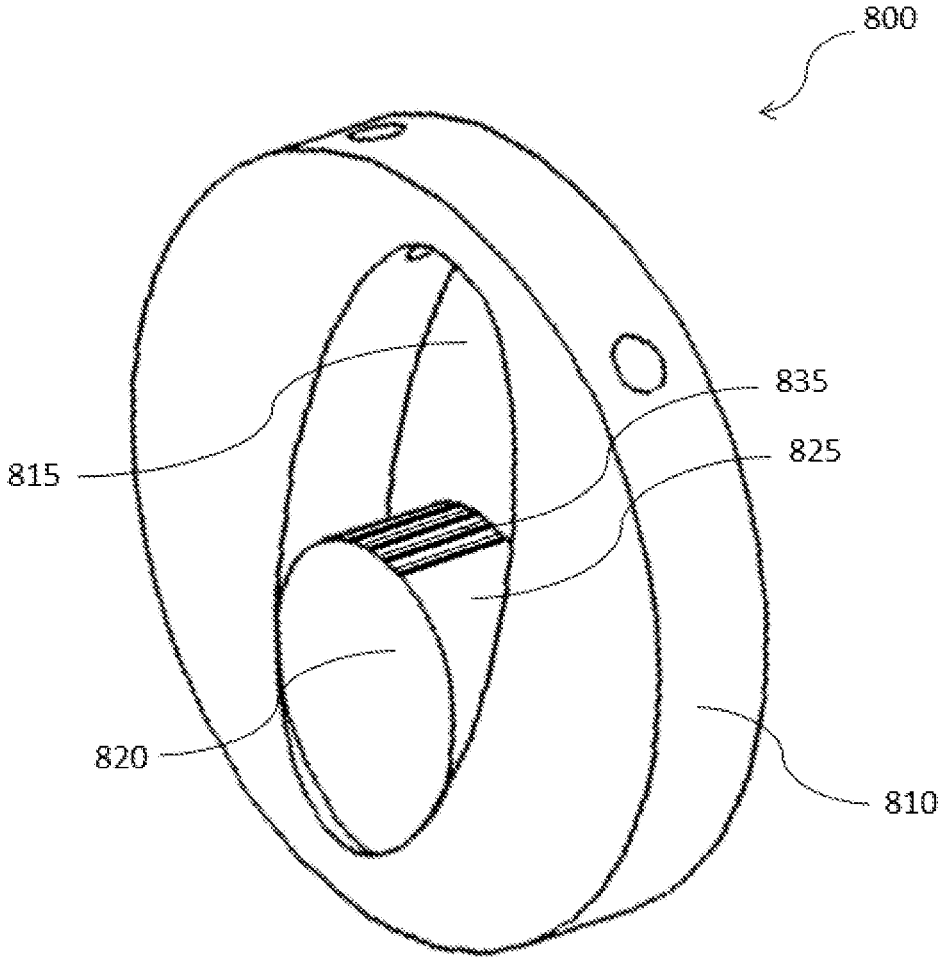
FIG. 8 is a perspective view of an embodiment of a rotor-stator assembly for a linear rotary machine, with grooves in a portion of the surface of the rotor.

FIG. 8 shows an embodiment of a rotor-stator assembly 800 for a linear rotary machine, with solids-handling features on the outer surface of the rotor. Rotor 820 is positioned inside stator cavity 815 of stator 810. Rotor 820 has a teardrop-shaped transverse cross-sectional profile, and the transverse cross-sectional profile of stator cavity 815 is an outwardly-offset ellipse. In this embodiment, there is a plurality of grooves 835 formed on a portion of surface 825 of rotor 820 for improved solids handling. In the illustrated embodiment grooves 835 are located on the more rounded end of rotor 820 and run parallel to the axis of rotor-stator assembly 800.

Figure 9:
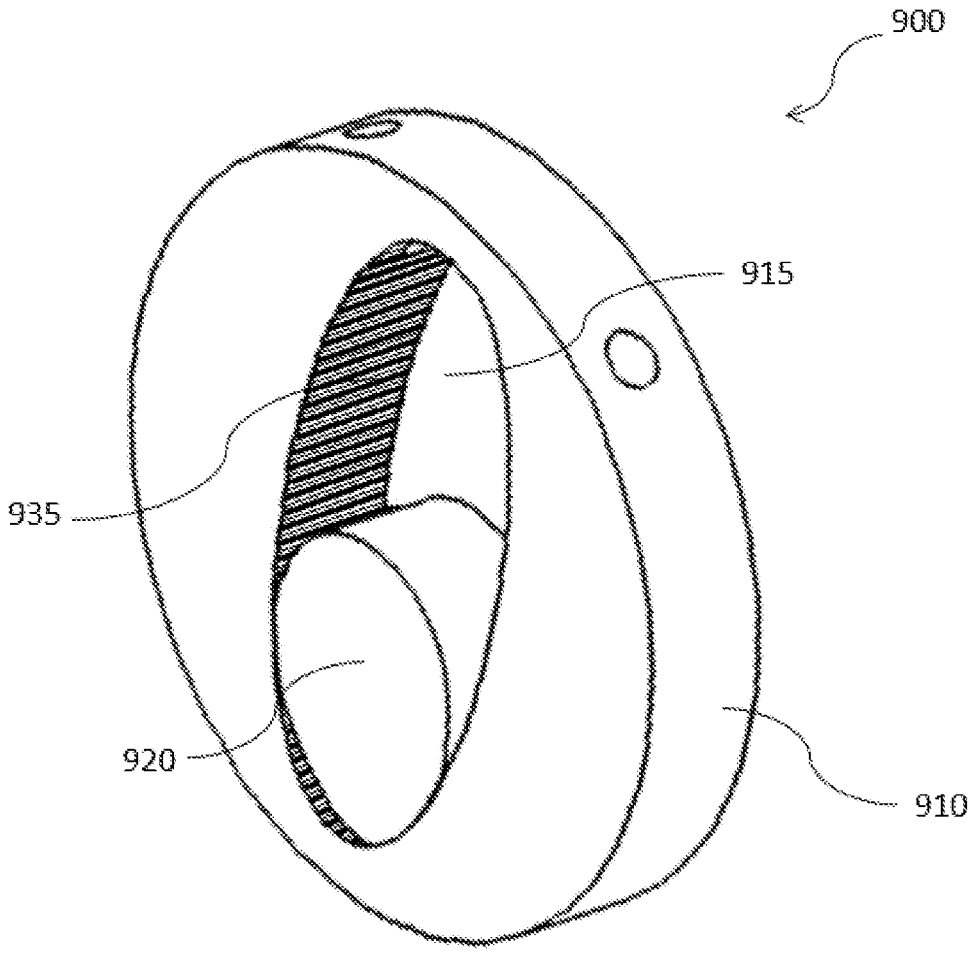
FIG. 9 is a perspective view of an embodiment of a rotor-stator assembly for a linear rotary machine, with grooves in the inner surface of the stator.

FIG. 9 shows an embodiment of rotor-stator assembly 900 for a linear rotary machine, with solids-handling features on the inner surface of the stator. Rotor 920 is positioned inside stator cavity 915 of stator 910. In this embodiment, there is a plurality of grooves 935 on the inner (fluid-facing) surface of stator 910 for improved solids handling. In the illustrated embodiment grooves 935 run parallel to the axis of rotor-stator assembly 900.

Figure 10:
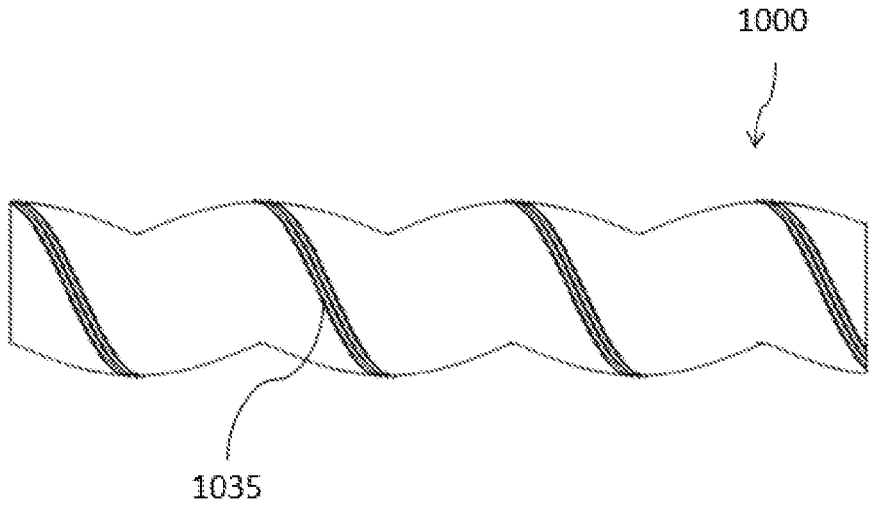
FIG. 10 is a side view of a helical rotor with a teardrop-shaped transverse cross-sectional profile, and pair of helical grooves formed in the outer surface thereof.

FIG. 10 shows a side view of helical rotor 1000 with a teardrop-shaped transverse cross-sectional profile, having a pair of helical grooves 1035 formed in the outer surface thereof, for improve solids handling.

Figure 11:
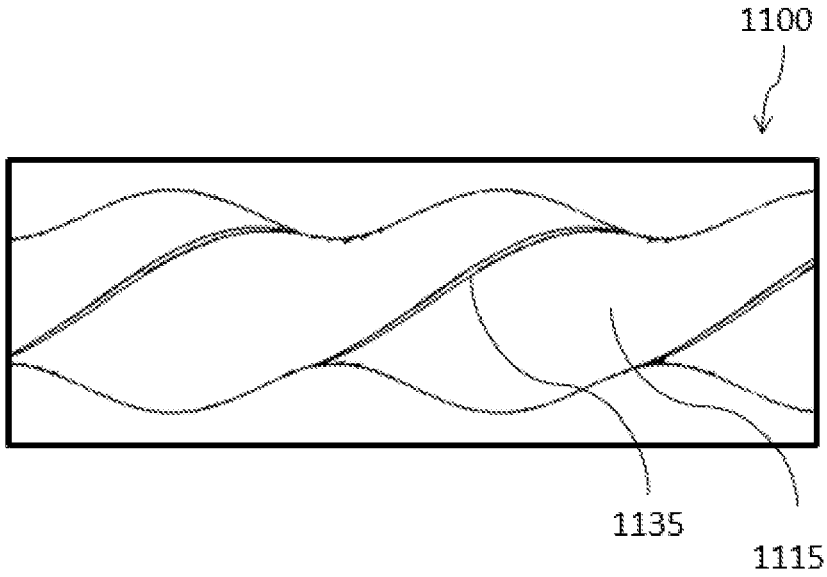
FIG. 11 is a side sectional view of a stator with a helical cavity having a transverse cross-sectional profile that is an outwardly-offset ellipse, and a helical groove formed in the inner surface thereof.

FIG. 11 shows a side sectional view of stator 1100 with helical cavity 1115, and having helical groove 1135 formed in the inner surface of stator 1100 for improved solids handling.

Figure 12:
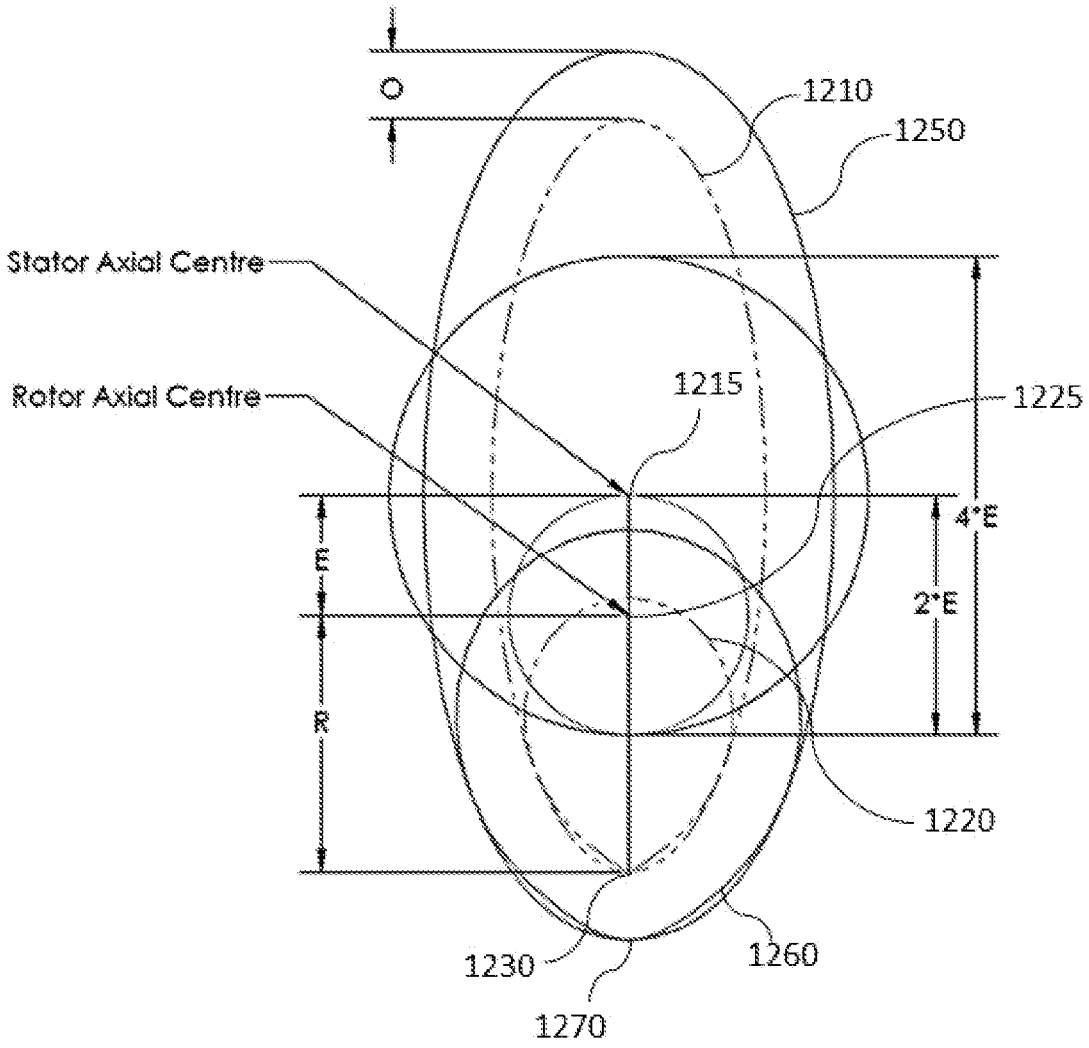
FIG. 12 is a schematic diagram illustrating geometry on which embodiments of rotary machines can be based.

The location and path of the groove(s) or other solids-handing features can be selected as appropriate to the specific rotary machine design and end-use application, and need not be as shown in FIGS. 8-11. Furthermore, in the illustrated examples the solids-handling features are grooves, but other features such as indentations, lattice patterns, and the like can be used. The geometry and architecture of the rotary machines described herein can be characterized or defined by the radius (R), eccentricity (E), offset (O), and pitch, as well as whether it is a helical or linear machine. FIG. 12 is a diagram illustrating these geometric parameters and their relationship to the rotor-stator geometries described in FIGS. 1A-C.

FIG. 12 shows an elliptical shape 1210 (dot-dash line) representing a stator cavity profile, and a teardrop shape 1220 (also shown with a dot-dash line) representing a corresponding rotor profile. Teardrop shape 1220 has a sharp tip 1230. FIG. 12 also shows an offset geometry with offset distance (O) measured perpendicular to a tangent to elliptical shape 1210 at each point. FIG. 12 shows a resulting outwardly offset elliptical shape 1250 representing a modified stator cavity profile, and a rounded teardrop shape 1260 representing a modified rotor profile. Teardrop shape 1260 has a rounded tip 1270.

Elliptical shape 1210 (representing a stator cavity profile) is the outer envelope formed by spinning teardrop shape 1220 (representing a rotor profile) about rotor axial centre 1225 in one direction and orbiting it about stator axial centre 1215 in the opposite direction at the same rate. When teardrop shape 1220 undergoes planetary motion, it orbits stator axial centre 1215 with an eccentricity E and spins a point at tip 1230 at radius R that scribes elliptical shape 1210. Similarly, outwardly offset elliptical shape 1250 is the outer envelope formed by spinning rounded teardrop shape 1260 about rotor axial centre 1225 in one direction and orbiting it about stator axial centre 1215 in the opposite direction at the same rate.

A helical stator cavity can be generated by sweeping elliptical shape 1210 along a helical path, where the axis of the helix is stator axial centre 1215. Similarly, a corresponding helical rotor can be generated by sweeping teardrop shape 1220 along a helical path, where the axis of the helix is rotor axial centre 1225.

Similarly, a helical stator cavity can be generated by sweeping outwardly-offset ellipse shape 1250 along a helical path, where the axis of the helix is stator axial centre 1215. Similarly, a corresponding helical rotor can be generated by sweeping rounded teardrop shape 1260 along a helical path, where the axis of the helix is rotor axial centre 1225.

As shown in FIG. 12, the distance between stator axial centre 1225 and rotor axial centre 1225 is referred to as the eccentricity (E).

Various factors can be taken into consideration when selecting the specific geometry and relative dimensions for the rotary machines. For example, for a particular fluid flux area in a helical pump, the pitch of the rotor and stator can be selected to provide the desired flow rate. In at least some embodiments, it is preferable to achieve a large flow area for a given pump outer diameter. The degree of offset (O) can be selected to dull the sharpness of the teardrop-shaped rotor tip such that the wear characteristics are reduced and/or so that a dynamic seal of equivalent or appropriate width can be practically used. Helical embodiments of the rotary machines are generally scalable and can be used in a wide range of applications.

Furthermore, the radius (R) and eccentricity (E) can be selected to reduce or eliminate sliding contact between the stator and the base of the teardrop-shaped rotor, which tends to be the highest contact pressure region of the rotor.

Figure 13A:
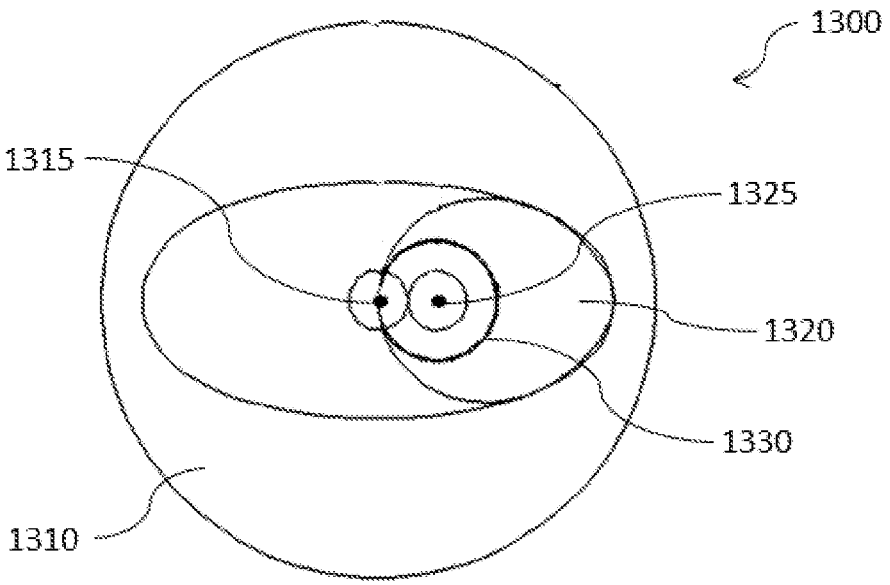
FIGS. 13A and 13B are transverse cross-sectional diagrams of a helical rotor-stator assembly taken at two points along the axis of a helical rotor-stator assembly with the rotor in a fixed position relative to the stator.
Figure 13B:
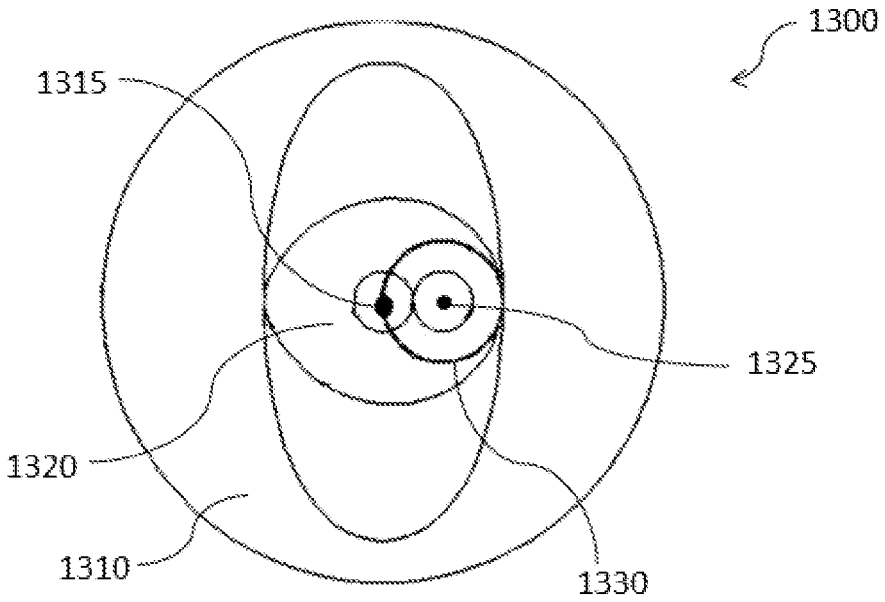
Figure 14A:
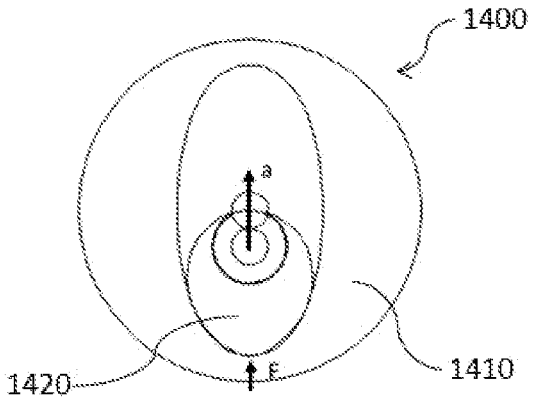
FIGS. 14A-D are transverse cross-sectional diagrams of a helical rotor-stator assembly at four different points in a revolution of the rotor within the stator, the points being where the largest normal force between the rotor and the stator generally occurs.
Figure 14B:
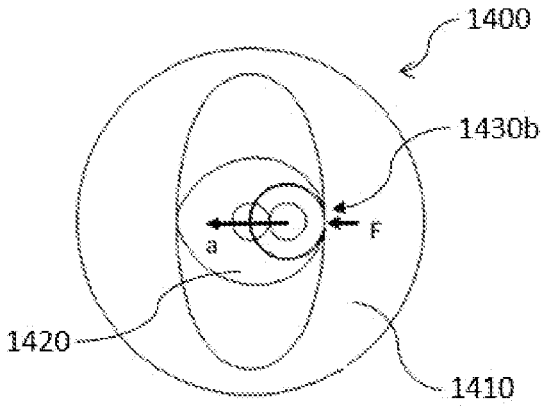
Figure 14C:
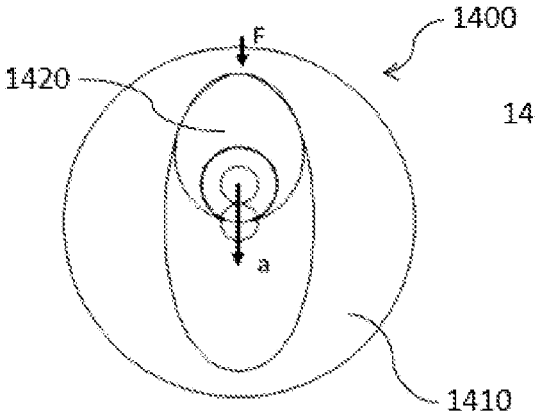
Figure 14D:
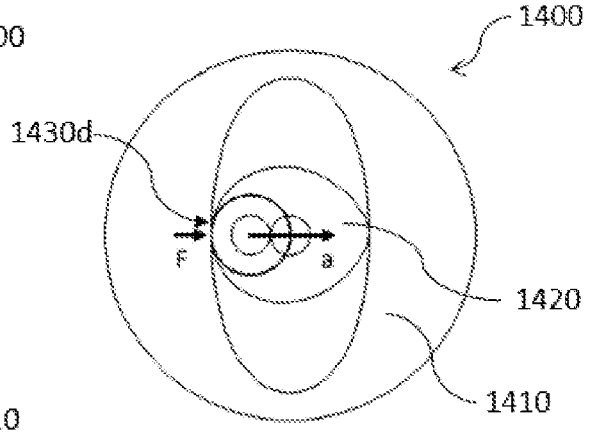

FIGS. 13A and 13B are transverse cross-sectional diagrams of a helical rotor-stator assembly 1300 taken at two points along the axis of a helical rotor-stator assembly 1300, with rotor 1320 in a fixed position relative to stator 1310. The centre of mass (or instantaneous center of velocity) of stator 1310 is at 1315, and the centre of mass of rotor 1320 is at point 1325. The instant centre of rotor 1320 is always on circle 1330 at the point furthest from the centre of stator 1315. When it comes to wear associated with two surfaces sliding against each other, the magnitude of normal force between the two surfaces affects the wear rate. The normal forces in at least some embodiments of the pumps are caused by fluid pressure and/or the centrifugal force of the orbiting rotor on the stator. The magnitude of the rotor's centrifugal force does not vary through a revolution, but the direction of that force does. The largest normal force between the rotor and stator occurs when the center of mass of the rotor is accelerating normal to a contact point between rotor and stator. This happens at four points in a revolution as shown in FIGS. 14A-D, which are transverse cross-sectional diagrams of helical rotor-stator assembly 1400 at four different points in a revolution of rotor 1420 within stator 1410. The direction of acceleration shown as "a", and the normal force between the rotor and stator is shown as "F". A dynamic seal along the crest of the rotor (if present) can support this force at two points in the revolution (as in FIGS. 14A and 14C). The other two points are opposite the rotor tip (see FIGS. 14B and 14D). These are the points in the revolution at which it is particularly desirable to reduce or minimize the sliding motion between rotor and stator surfaces, in regions shown as 1430*b* and 1430*d*. This region of the rotor also has the smallest radius of curvature, other than at the rotor tip, so the contact area of the rotor with the stator is small which tends to increase the wear rate caused by sliding of rotor against the stator. Sliding motion at this point can be reduced or minimized by reducing the distance between the instantaneous center of velocity (see FIGS. 13A and 13B) and this point. In some embodiments a linear or helical machine geometry where R+O=3E can be used to achieve this.

There can be other regions where it is desirable to reduce sliding contact between the rotor and stator. For example, in some embodiments, it is desirable to reduce sliding contact between the rotor and stator closer to the tips (in cross-section) of the stator cavity. In some embodiments a linear or helical machine geometry where R+O<3E can be used to achieve this.

Another factor that can be taken into consideration when selecting the specific geometry and relative dimensions of the rotary machines is the thickness of the stator walls. Generally a stator cavity with a less elongated circular transverse cross-section (e.g. an ellipse or outwardly-offset ellipse where the major and minor axes are similar) allows for a more uniform stator wall thickness in a stator that has a cylindrical exterior. Also, a more circular rotor profile can reduce the bending stress from having a low area moment of inertia about a principal axis and can increase the durability of the rotor. Reducing eccentricity (E) results in a stator cavity with a less elongated circular transverse cross-sectional profile and a more circular rotor profile. Reducing E and/or reducing the mass of the rotor also tends to reduce the centrifugal force.

In at least some embodiments, increasing the offset (O) results in a higher radius of curvature on all features of the rotor and the stator, which can be beneficial by reducing contact pressure and wear.

As discussed above, the geometry of the rotary machine can be selected to achieve desirable rotor and stator profiles and/or objectives that can be advantageous both physical operationally.

For many applications, particularly where the linear or helical rotary machines are used as pumps, embodiments where R+O≤3E are desirable. In some embodiments it is desirable to reduce or minimize eccentricity (E) and/or increase or maximise offset (O), noting that R is always greater than E.

Embodiments of the rotary machines described herein can be used in various applications including as pumps, compressors, generators, expansion engines and the like.

In at least some embodiments of the rotary machines described herein, the working principal of the rotary machine is independent of which components of the machine are "fixed" and which components are rotating. In some embodiments, for example, the machine can be operated such that the stator is fixed and the rotor spins and undergoes planetary motion (orbits) within it. This configuration is mechanically simple and compact, but sometimes requires counterweights to provide balance. In other embodiments, an outer stator undergoes planetary motion about an inner rotor.

Some embodiments of the rotary machines are operated such that the rotor spins but does not orbit. For example, in some embodiments the rotor spins but can be held at a specific eccentricity relative to the stator, and the stator can also be allowed to spin, so that the rotor and stator each revolve around their respective longitudinal axes. In such embodiments, even though the rotor and stator are each spinning (i.e. rotating) about their respective longitudinal axes, the relative motion of the components is basically the same as in corresponding fixed stator embodiments where the rotor spins and orbits within the stator.

In at least some embodiments, holding the rotor and stator at a fixed eccentricity in space and having these components spin about their longitudinal axes, rather than having one of them orbit, can reduce problems with vibration and make the machine more balanced in operation.

With such rotary machine designs, one approach is to drive the rotor, for example by coupling it to a motor via a drive shaft, and allowing the rotation of the rotor to drive the rotation of the stator. In some embodiments, the stator could be driven instead of the rotor. In some embodiments, the eccentricity is still fixed, but instead of the rotor driving the stator (or vice versa), a gear set is used, and both the rotor and the stator are driven via gears.

In at least some embodiments, it is preferred to rotate the rotor rather than the stator. However, in some rotary machines where the stator spins at twice the rate of the rotor, it has been found that there is less tendency for issues with camming etc. if the stator is driven and is used to drive the rotor. In machines having the geometry described herein, the rotor and stator spin at the same rate, so either component can be used to drive the other. In some embodiments, it is preferable to drive the rotor and use it to drive the stator.

Figure 15:
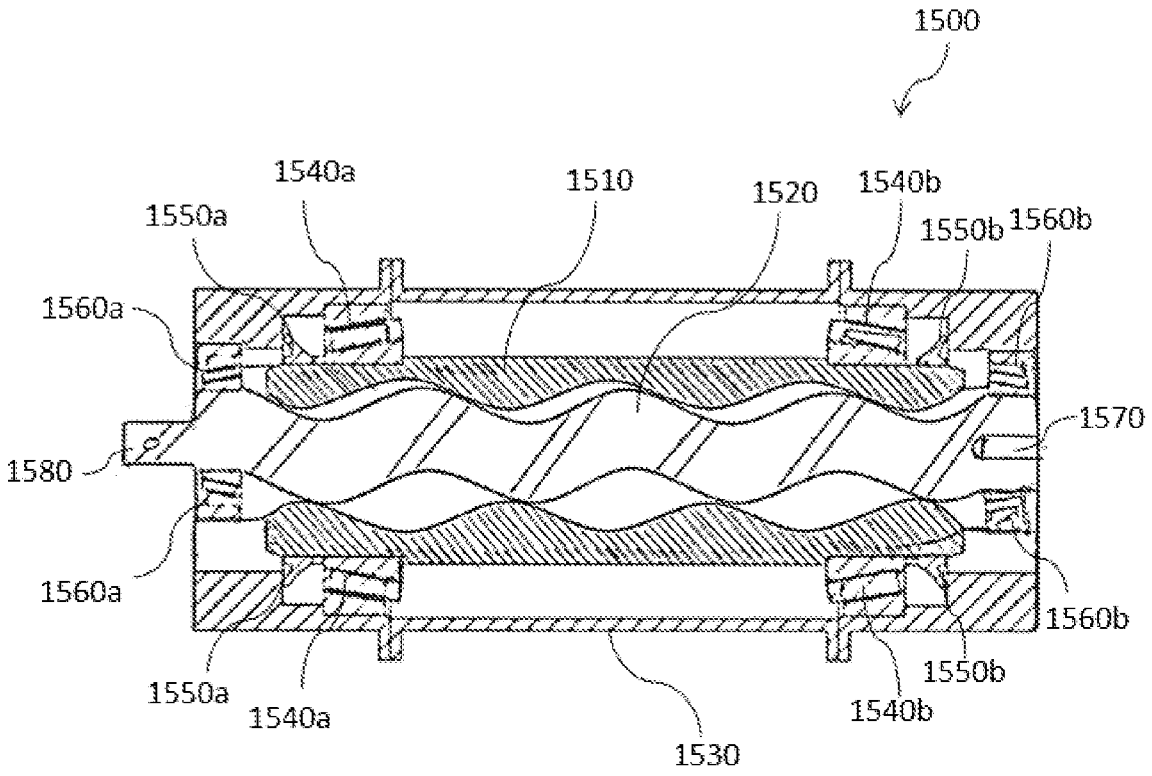
FIG. 15 is a side sectional view of an embodiment of a fixed-eccentricity rotary machine assembly with a helical rotor having a teardrop-shaped transverse cross-section, a stator having an outwardly-offset elliptical transverse cross-section, and a carrier, where the rotor is configured to drive the stator.

FIG. 15 is a cross-sectional view of fixed-eccentricity rotary machine assembly 1500. Assembly 1500 comprises stator 1510 having a cavity with an outwardly-offset elliptical transverse cross-section, helical rotor 1520 having a a teardrop-shaped transverse cross-section, and carrier 1530. Stator 1510 is constrained concentrically within carrier 1530 and is supported by stator-carrier bearings 1540*a* and 1540*b* so that it can spin about its axis within carrier 1530, but is constrained axially and radially. Annular stator-carrier seals 1550*a* and 1550*b* can be used to mitigate or prevent fluid leakage around the rotor-stator assembly. Rotor 1520 is constrained within stator 1510 at a position offset from the axis of stator 1510 and carrier 1530 by a distance equal to the eccentricity (E). Rotor 1520 is supported by rotor-carrier bearings 1560*a* and 1560*b* and anchor pin 1570 so that it can spin about its axis within stator 1510. Rotor 1520 can be coupled to a drive shaft via coupling 1580 and driven by a motor (not shown in FIG. 15), so that it spins about its axis, and drives stator 1510 at the same rate as the rate of spin of rotor 1520.

For downhole pump or artificial lift applications of rotary machines in which the stator is fixed and rotor is configured to spin and orbit within the stator, a drive-string can be coupled to the rotor to drive the rotor to spin and orbit. In some embodiments, the pump can be top-driven where the motor is at the surface and is coupled to the rotor (or stator or gear system) via a drive-string. In at least some embodiments, top-driven systems are limited to fairly low rotational speeds, due to the centrifugal forces from the rotor and/or limits on the rotational speed of the drive-string. In some embodiments, the pump can be used with a direct-drive system, similar to an electric submersible pump (ESP), where the motor is below the surface (e.g. underground). In at least some embodiments, such direct-drive ESP systems can achieve higher rotational speeds.

In some embodiments of the rotary machines, the rotor and/or the stator are plastic. In some embodiments, the rotor and/or the stator can be metal. In some embodiments, depending on the application, the rotor and/or stator can be made from ceramic, elastomeric other suitable materials or combinations of materials. The material(s) of the rotor can be the same as, or different from, the material(s) of the stator.

Some embodiments of the rotary machines operate with a small clearance between the helical rotor and stator, but without seals between them.

In at least some embodiments, the helical rotary machines described herein are multi-stage machines. However, the same principles can be applied to machines having a single stage or, in some embodiments, with less than a complete stage (where there is no complete trapped chamber or volume of fluid between the ends of the machine).

In multi-stage embodiments of helical trochoidal rotary machines, if the rotor and stator pitch and all dimensions (including E, R and O) remain constant, or at least essentially constant, along the length of the rotor-stator assembly, then the volume and dimensions of the fluid chambers between the helical rotor and the stator is the same along the length (or axis) of the assembly. Such rotary machines can be used, for example, as pumps and, if driven at constant speed, can provide a substantially steady volumetric flow rate or output.

In some multi-stage embodiments, the rotor-stator geometry can be varied, in a continuous or stepwise manner, along the length (or axis) of the helical rotary machine. In some embodiments, it can be advantageous to vary the geometry of the rotor-stator along the length of the rotary machine, while keeping the volume of the fluid chambers between the helical rotor and the stator approximately the same along a length of the rotor-stator assembly.

In some embodiments, the rotor-stator geometry can be varied so that the volume of the fluid chambers varies along the length (or axis) of the machine, such as may be desirable for compressor or expander applications, for example. For example, for compressors or expansion engine applications, the pitch or eccentricity of the rotary machine can be varied along its length. In embodiments in which the pitch (only) is varied, the rotor and stator can undergo increased pitch frequency thereby reducing the volume of the fluid chambers in either a stepwise, or continuous fashion or the pitch frequency can increase thereby increasing the volume of the chambers in either a stepwise, or continuous fashion.

Figure 16:
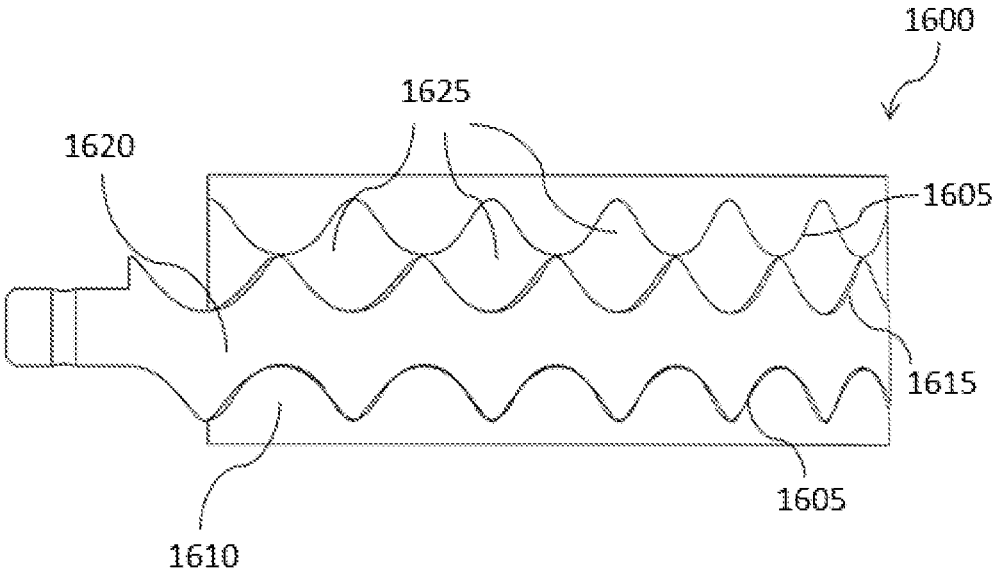
FIG. 16 is a side sectional view of an embodiment of a rotor-stator assembly in which the pitch of a helical stator and rotor varies along the length of the assembly.

FIG. 16 shows a side sectional view of an example of rotor-stator assembly 1600 in which the pitch of a helical stator and rotor varies along the length of the assembly. Assembly 1600 includes helical rotor 1620 with a teardrop-shaped transverse cross-sectional profile, and stator 1610 having helical stator cavity defined by inner surface 1605, with a transverse cross-sectional profile that is an outwardly-offset ellipse. Inner surface 1605 of stator 1610 and outer surface 1615 of rotor 1620 define a plurality of fluid chambers 1625 between stator 1610 and rotor 1620. In the illustrated embodiment the pitch of stator 1610 and rotor 1620 gradually decreases, and the volume of fluid chambers 1625 decreases, along the length of assembly 1600 from left to right.

Figure 17:
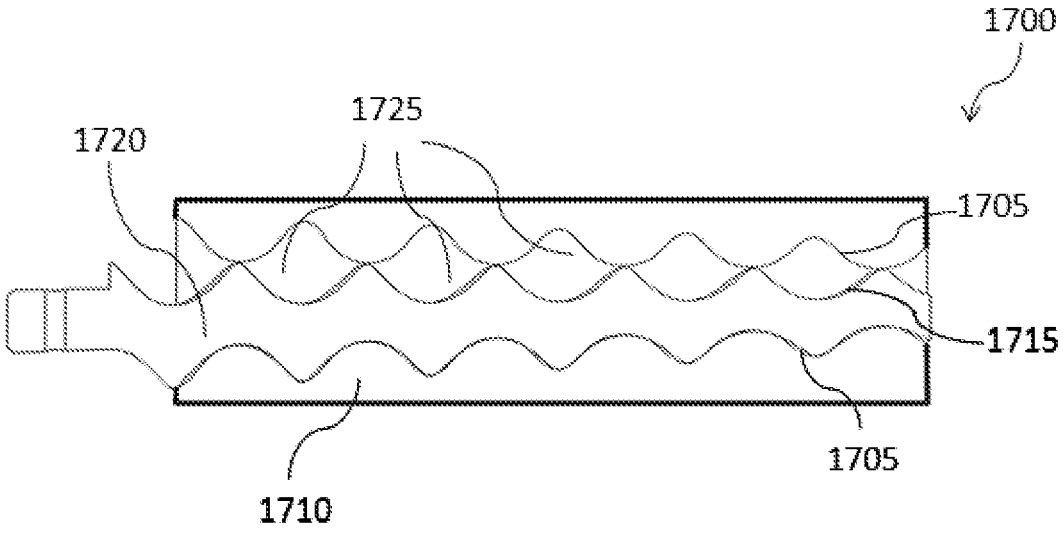
FIG. 17 is a side sectional view of an embodiment of a rotor-stator assembly in which the pitch of a stator and rotor is constant along the length of the assembly, and the helical rotor and stator cavity are tapered.

FIG. 17 shows a side sectional view of an example of rotor-stator assembly 1700 in which the pitch of a stator and rotor is constant along the length of the assembly, but the helical rotor and stator cavity are tapered and their axes are parallel (i.e. the radius R and/or offset O vary along the length of the assembly, and eccentricity E remains constant). Assembly 1700 includes helical rotor 1720 with a teardrop-shaped transverse cross-sectional profile, and stator 1710 having helical stator cavity defined by inner surface 1705, with a transverse cross-sectional profile that is an outwardly-offset ellipse. Inner surface 1705 of stator 1710 and outer surface 1715 of rotor 1720 define a plurality of fluid chambers 1725 between stator 1710 and rotor 1720. In the illustrated embodiment, stator 1710 and rotor 1720 are tapered and the volume of fluid chambers 1725 decreases, along the length of assembly 1700 from left to right.

In some embodiments in which the eccentricity (E) and radius (R) are varied along the axis of the machine, the rotor axis is no longer parallel to the stator axis. In at least some such embodiments, the rotor axis orbits in a conical motion relative to the stator axis. The axes can converge to a point where they meet and where the orbit and spin radius drop to zero. In some embodiments a single spherical bearing can be used at this location to provide an axial and planetary motion singular constraint. In other embodiments, a single drive shaft could be used to both drive and constrain the rotor at this conversion of axis. For example, a variable eccentric compressor or expander could be driven by a motor and a shaft with a universal joint located at the rotor and stator convergence point, then directly connected to the rotor. Other forms of joint or coupling connecting rigid rods whose axes are inclined to each other could be used. Each layer of variable eccentric rotor and stator profiles would be mapped onto an array of spherical surfaces centered about the convergence of axis.

Figure 18:
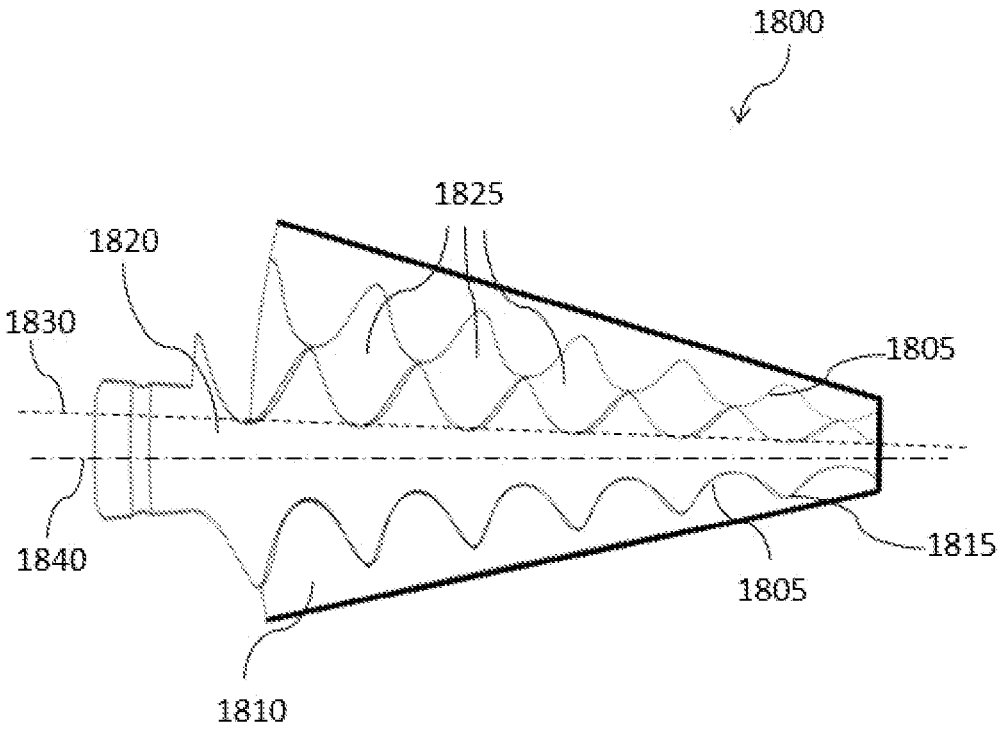
FIG. 18 is a side sectional view of an embodiment of a rotor-stator assembly in which a helical rotor and stator cavity are tapered, and the rotor axis is not parallel to the stator.

FIG. 18 shows a side sectional view of an example of a rotor-stator assembly 1800 in which a helical rotor and stator cavity are tapered, and the rotor axis is not parallel to the stator axis and orbits in a conical motion relative to the stator axis (the eccentricity E varies along the length of the assembly). Rotor-stator assembly 1800 includes a helical rotor 1820 with a teardrop-shaped transverse cross-sectional profile, and a stator 1810 having helical stator cavity defined by inner surface 1805, with a transverse cross-sectional profile that is an outwardly-offset ellipse. Stator axis indicated by dashed line 1830 is angled (non-parallel) to rotor axis indicated by dot-dash line 1840. Inner surface 1805 of stator 1810 and outer surface 1815 of rotor 1820 define a plurality of fluid chambers 1825 between stator 1810 and rotor 1820. In the illustrated embodiment, stator 1810 and rotor 1820 are tapered and the volume of fluid chambers 1825 decreases, along the length of rotor-stator assembly 1800 from left to right.

In at least some applications where the rotary machines are used as compressors or expanders, it can be advantageous to cool the fluids. In some embodiments coolant channels or paths can be provided within the body of the rotor and/or stator for active cooling of the machines during operation. This can facilitate attaining near isothermal compression or expansion.

In at least some compression applications it can be beneficial to incorporate passageways in the stator and or rotor interconnecting adjacent fluid chambers in the machine, the passageways equipped with one-way valves which can activate if the pressure from compression exceeds the outlet pressure: thereby allowing the compressed fluids to move upstream. Similarly, for expansion applications a series of valves located in passageways in the stator and/or rotor can be configured to dump fluid down-stream if overexpansion is reached within the fluid chambers. In other embodiments, instead of having in passageways in the rotor or stator between fluid chambers, the passageways and valves could simply interact through the stator or rotor to a manifold outside of the unit.

Throughout the following description, specific details are set forth in order to provide a more thorough understanding of the invention. However, the invention can be practiced without these particulars. In other instances, well-known elements have not been shown or described in detail to avoid unnecessarily obscuring the description. Accordingly, the specification and drawings are to be regarded in an illustrative, rather than a restrictive sense.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, permanent or non-permanent, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms;

Unless otherwise indicated, words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description, depend on the specific orientation of the apparatus described and illustrated. The subject matter described herein can assume various orientations. Accordingly, these directional terms are not strictly defined and should not be interpreted narrowly.

Where a component is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which perform the function of the described component.

Specific examples of systems, methods and apparatus have been described herein for purposes of illustration.

These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A rotary machine comprising a stator having a stator cavity and a rotor disposed within said stator cavity, said rotor having a rotor helical profile, and a rotor axis, and having a rotor shape in cross-section transverse to said rotor axis along at least a portion of a length of said rotor that is a teardrop shape, said stator cavity having a stator helical profile, a stator axis, and having a stator shape at any cross-section transverse to said stator axis along at least a portion of a length of said stator cavity that is an outer envelope formed when said teardrop shape undergoes planetary motion, wherein said rotary machine is configured so that, in operation of said rotary machine, said rotor undergoes planetary motion relative to said stator, and wherein said stator shape is an outwardly-offset ellipse, and said rotary machine has a geometry characterized by a radius R, an offset O and an eccentricity E, wherein E is the distance between said rotor axis and said stator axis, O is greater than zero, R is greater than E, and $R+O \geq 3E$.

2. The rotary machine of claim 1 further comprising a helical dynamic rotor seal mounted on said rotor.

3. The rotary machine of claim 1 wherein said rotary machine is configured so that, in operation of said rotary machine, said rotor spins about said rotor axis and orbits about said stator axis within said stator cavity.

4. The rotary machine of claim 1 wherein said rotary machine is a multi-stage machine having a plurality of chambers between cooperating fluid-facing surfaces of said rotor and said stator.

5. The rotary machine of claim 4 wherein each of said plurality of chambers has approximately the same volume.

6. The rotary machine of claim 4 wherein said rotary machine is a pump.

7. The rotary machine of claim 4 wherein each of said plurality of chambers has a different volume.

8. The rotary machine of claim 1 further comprising a helical dynamic rotor seal mounted on said rotor, said helical dynamic rotor seal comprising bristles extending from a fluid-facing surface thereof.

9. A rotary machine comprising a stator having a stator cavity and a rotor disposed within said stator cavity, said rotor having a rotor helical profile, and a rotor axis, and having a rotor shape in cross-section transverse to said rotor axis along at least a portion of a length of said rotor that is a teardrop shape, said stator cavity having a stator helical profile, a stator axis, and having a stator shape at any cross-section transverse to said stator axis along at least a portion of a length of said stator cavity that is an outer envelope formed when said teardrop shape undergoes planetary motion, wherein said rotary machine is configured so that, in operation of said rotary machine, said rotor undergoes planetary motion relative to said stator, and wherein said stator shape is an outwardly-offset ellipse, and said rotary machine has a geometry characterized by a radius R, an offset O and an eccentricity E, wherein E is the distance between said rotor axis and said stator axis, O is greater than zero, R is greater than E, and $R+O=3E$.

10. The rotary machine of claim 9 further comprising a helical dynamic rotor seal mounted on said rotor.

11. The rotary machine of claim 9 wherein said rotary machine is configured so that, in operation of said rotary machine, said rotor spins about said rotor axis and orbits about said stator axis within said stator cavity.

12. The rotary machine of claim 9 wherein said rotary machine is a multi-stage machine having a plurality of chambers between cooperating fluid-facing surfaces of said rotor and said stator.

13. The rotary machine of claim 12 wherein each of said plurality of chambers has approximately the same volume.

14. The rotary machine of claim 12 wherein said rotary machine is a pump.

15. A rotary machine comprising a stator having a stator cavity and a rotor disposed within said stator cavity, said rotor having a rotor helical profile, and a rotor axis, and having a rotor shape in cross-section transverse to said rotor axis along at least a portion of a length of said rotor that is a teardrop shape, said stator cavity having a stator helical profile, a stator axis, and having a stator shape at any cross-section transverse to said stator axis along at least a portion of a length of said stator cavity that is an outer envelope formed when said teardrop shape undergoes planetary motion, wherein said rotary machine is configured so that, in operation of said rotary machine, said rotor undergoes planetary motion relative to said stator, and wherein said stator shape is an outwardly-offset ellipse, and said rotary machine has a geometry characterized by a radius R, an offset O and an eccentricity E, wherein E is the distance between said rotor axis and said stator axis, O is greater than zero, R is greater than E, and $R+O>3E$.

16. The rotary machine of claim 15 further comprising a helical dynamic rotor seal mounted on said rotor.

17. The rotary machine of claim 15 wherein said rotary machine is configured so that, in operation of said rotary machine, said rotor spins about said rotor axis and orbits about said stator axis within said stator cavity.

18. The rotary machine of claim 15 wherein said rotary machine is a multi-stage machine having a plurality of chambers between cooperating fluid-facing surfaces of said rotor and said stator.

19. The rotary machine of claim 18 wherein each of said plurality of chambers has approximately the same volume.

20. The rotary machine of claim 18 wherein said rotary machine is a pump.

* * * * *